US007281535B2

(12) United States Patent
Mihai et al.

(10) Patent No.: US 7,281,535 B2
(45) Date of Patent: Oct. 16, 2007

(54) SAW SINGULATION

(75) Inventors: Chris Mihai, Morgan Hill, CA (US); Teang K Khor, Milpitas, CA (US); Marcus F. Donker, Wijchen (NL); Leonardus A. E. Gemert, Eindhoven (NL)

(73) Assignees: Towa Intercon Technology, Inc., Morgan Hill, CA (US); Koninklijke Philips Electronics, N.V. (NL)

( * ) Notice: Subject to any disclaimer, the term of this patent is extended or adjusted under 35 U.S.C. 154(b) by 0 days.

(21) Appl. No.: 11/061,126

(22) Filed: Feb. 18, 2005

(65) Prior Publication Data

US 2005/0268899 A1 Dec. 8, 2005

Related U.S. Application Data

(60) Provisional application No. 60/547,398, filed on Feb. 23, 2004.

(51) Int. Cl.
*B28D 1/04* (2006.01)

(52) U.S. Cl. ..... 125/13.01; 451/102; 83/22; 83/169

(58) Field of Classification Search ..... 125/13.01; 451/102; 83/22, 169, 171, 16
See application file for complete search history.

(56) References Cited

U.S. PATENT DOCUMENTS 3,479,097 A * 11/1969 McLauchlan et al. ..... 384/12
3,623,520 A * 11/1971 Neild ..... 83/169
3,848,929 A * 11/1974 Miller ..... 299/39.4
4,131,267 A 12/1978 Ono et al.
4,521,995 A 6/1985 Sekiya
4,625,463 A 12/1986 Sekiya
4,652,135 A 3/1987 Ono
4,672,557 A 6/1987 Tamura et al.
4,688,540 A 8/1987 Ono
4,696,712 A 9/1987 Nonaka
4,715,254 A * 12/1987 DeGan ..... 83/169
4,720,635 A 1/1988 Uga (Continued)

FOREIGN PATENT DOCUMENTS

DE 197 48 055 A 1 12/1998

(Continued)

OTHER PUBLICATIONS

European Patent Examination Report dated Mar. 19, 2007, from related Foreign Patent Application No. 05 723 354.6-2302. 3 pages.

*Primary Examiner*—Joseph J. Hail, III
*Assistant Examiner*—Robert Scruggs
(74) *Attorney, Agent, or Firm*—Beyer Weaver LLP

(57) ABSTRACT

Improved systems and methods for singulating a substrate into a plurality of integrated circuit devices are disclosed. One aspect of the invention corresponds to a fixture that holds the substrate during the dicing process. Another aspect of the invention pertains to a nozzle assembly that provides better fluid flow over the cutting blades. Another aspect of the invention corresponds to a nozzle adjustment assembly that helps position the nozzles relative to the blades. Another aspect of the invention corresponds to spacers that reduce the problem of imbalance caused by fluid retained therein. Yet another aspect pertains to the composition of the fluid, which is distributed by the nozzle assembly to the blades.

10 Claims, 15 Drawing Sheets

U.S. PATENT DOCUMENTS 4,846,623 A 7/1989 Otani et al.
4,872,289 A 10/1989 Yukawa et al.
5,159,866 A * 11/1992 Dunham ..... 83/169
5,331,743 A * 7/1994 Lump ..... 30/388
5,761,979 A * 6/1998 McGehee ..... 83/425.3
5,915,370 A 6/1999 Casper
6,055,694 A 5/2000 Steere
6,102,023 A 8/2000 Ishiwata et al.
6,107,164 A 8/2000 Ohuchi
6,165,232 A 12/2000 Tieber et al.
6,216,682 B1 4/2001 Nambu et al.
6,250,990 B1 6/2001 Yoshii et al.
6,277,001 B1 8/2001 Saito
6,286,499 B1 9/2001 Yoshii et al.
6,290,274 B1 9/2001 Montoya
6,295,889 B1 10/2001 Jones
6,341,740 B2 1/2002 Sekiya et al.
6,344,402 B1 2/2002 Sekiya
6,345,616 B1 2/2002 Umahashi
6,354,285 B1 3/2002 Licht et al.
6,361,404 B1 3/2002 Ishiwata et al.
6,371,100 B2 4/2002 Sekiya
6,381,796 B1 5/2002 Sato
6,382,609 B1 5/2002 Namioka et al.
6,386,191 B1 5/2002 Yoshimura et al.
6,448,151 B2 9/2002 Tateishi
6,465,158 B1 10/2002 Sekiya
6,483,180 B1 11/2002 Bayan et al.
6,489,218 B1 12/2002 Kim et al.
6,494,122 B2 12/2002 Kamigaki
6,494,197 B1 12/2002 Yoshimura et al.
6,494,775 B1 12/2002 Abrahamians et al.
6,500,047 B2 12/2002 Arai et al.
6,500,058 B2 12/2002 Bajo et al.
6,568,385 B2 5/2003 Sekiya et al.
6,581,586 B2 6/2003 Sekiya
6,582,287 B2 6/2003 Sasayama
6,593,170 B2 7/2003 Tateiwa et al.
6,606,985 B2 8/2003 Negishi
6,705,188 B2 * 3/2004 Gravely et al. ..... 83/22
2002/0160695 A1 10/2002 Osada et al.

FOREIGN PATENT DOCUMENTS

WO 02/090075 11/2002

* cited by examiner

SAW SINGULATION

CROSS REFERENCE TO RELATED APPLICATION

This application claims the priority of U.S. Provisional No. 60/547,398, filed on Feb. 23, 2004, which is hereby incorporated by reference.

FIELD OF THE INVENTION

The invention generally relates to integrated circuit processing equipment. More particularly, the invention relates to improved systems and methods associated with dicing a substrate into a plurality of integrated circuit packages.

BACKGROUND OF THE INVENTION

A singulation procedure is typically performed to separate integrated circuit packages such as IC chips from a substrate such as a carrier or circuit board. During singulation, the substrate is typically held in place while one or more saw blades cut straight lines through the substrate in order to form the individual integrated circuit packages. This is sometimes referred to as "dicing."

FIG. 1 is an exemplary diagram of a conventional dicing apparatus 2. The dicing apparatus 2 includes a fixture 4 for holding the substrate 6 during a dicing procedure, and a saw assembly 8 for performing the dicing procedure. The saw assembly 8 typically includes a rotating cutting blade 10 that is translated through the substrate 6 in order to cut parts therefrom. The cutting blade 10 is typically attached to a spindle 12 that rotates via a motor (not shown). Spacers may be provided on the spindle 12 between blades if more than one blade is used. Furthermore, in order to cool the blade 10 during the dicing procedure the saw assembly 8 may include a spray nozzle 16 that is spaced apart from the cutting blade 10. The spray nozzle 16 produces a stream of fluid 18 that is directed at the leading edge 20 of the cutting blade 10 near the cutting surface.

Although saw singulation works well, continuing advancements in the industry have tested the limitations of saw singulation. For example, Quad Flat No Lead (QFN) packages, which are one of the most cutting edge packaging technologies to recently emerge in the electronic marketplace, have been stifled by the inability of saw singulation to deliver effective results. In QFN, the dicing process may suffer from blade breakage, cut quality failures, part movement, low feed speed, short blade life and low throughput. The is due in part to the configuration of QFN packages, which are small and which include copper leads, and a mold compound through which the saw blade must cut in order to singulate the individual QFN packages from the substrate.

To elaborate, one problem with the current dicing process is that scrap material may be thrown into the blade or become trapped between the blade and portions of the fixture and this may cause blade breakage or poor cut quality. Another problem with the dicing process is that the feed rates are kept low to prevent excessive blade wear and poor cut quality (e.g., chips, burrs). For example, QFN singulation typically requires specially formulated blades that must constantly expose new diamonds to the cut interface. As the diamonds remove material, they are "dulled" by the materials used in the substrate and must be sloughed-off as the blade wears at a higher-than-normal rate. The balance between blade wear and cut quality is a delicate trade-off requiring costly technology to extend blade life while minimizing burrs and chips.

Another problem with the dicing process is that the substrate and parts cut therefrom may move during the cutting process. As should be appreciated, the saw blade(s) is both rotating and translating relative to the device under process. The resulting force vectors have both vertical and shear components, which can overwhelm the holding force of the fixture thereby causing part movement. As feed rates increase, the magnitude of the shear component increases commensurately and magnifies the device retention problem. As a result of this movement, non conforming geometries, damage and lost parts may be created. Even if the parts do not move, the shearing forces created by the cutting blade may cause the copper leads to smear thereby creating non conforming parts.

Another problem with the dicing process is that the blades can become imbalanced, and imbalanced blades can cause blade breakage, excessive blade wear and poor cut quality. By way of example, the blade(s) may become imbalanced by spacers located on the sides of the blade. The imbalance may be caused by fluid accumulation inside or around the spacers. As shown in FIGS. 2A and 2B, spacers 22 consist of an annular member 23 having an inner radius 24 that fits around the spindle 12 and an outer radius 26 including a raised surface 28 extending from its side that presses against the side of the blade 10. As shown in FIG. 2C, the spacers 22 are designed to only contact the blades 10 along their raised surfaces 28, thus leaving a gap or cavity 30. Unfortunately, during the dicing process, the fluid used in the dicing process (e.g., fluid stream 20) tends to accumulate in this gap 30 thereby creating imbalance problems when the blades 10 are rotated via the spindle 12.

In view of the foregoing, it would be desirable to provide improved systems and methods for dicing a substrate into a plurality of integrated circuit packages.

SUMMARY OF THE INVENTION

The invention relates, in one embodiment, to a pin-less nest assembly. The pin-less nest assembly includes a pin holder plate having a plurality of locator pins. The pin-less nest assembly also includes a nest configured to temporarily mate with the pin holder plate during placement of a substrate thereon. The nest includes a plurality of locator holes that coincide with the locator pins of the pin holder plate. The locator pins protrude above a top surface of the nest when the nest and pin holder plate are mated and when the locator pins are positioned through the locator holes of the nest. The portion of the locator pins protruding above the top surface of the nest help align the substrate to the nest.

The invention relates, in another embodiment, to a nozzle for directing flow of a fluid across one or more semiconductor device cutting blades. The nozzle includes an elongated member configured to protrude toward a cutting blade for cutting a semiconductor device. The nozzle also includes a plurality of channels formed in the elongated member. The channels are each configured to at least partially surround a cutting blade so as to simultaneously direct flow of a fluid onto the cutting edge of the cutting blade and onto the sides of the cutting blade.

The invention relates, in another embodiment, to a fine positioning mechanism for adjusting the position of a spray nozzle relative to a semiconductor device cutting blade. The mechanism includes a spindle bracket coupled to a spindle. The spindle facilitating the rotation of a cutting blade for cutting a semiconductor device. The mechanism also includes a nozzle bracket movably coupled to the spindle bracket and configured to support a spray nozzle assembly for directing a fluid onto the cutting blade. The nozzle bracket is further configured to move relative to the spindle bracket so as to adjustably position the spray nozzle assembly relative to the cutting blade.

The invention relates, in another embodiment, to a spacer for separating semiconductor device cutting blades. The spacer includes a generally annular rigid member having an inner surface at its inner radius, an outer surface at its outer radius, and first and second surfaces extending substantially from the inner surface to the outer surface. The first surface is opposite to the second surface. The first and second surfaces are substantially planar surfaces each configured to be placed in substantially continuous contact with semiconductor device cutting blades so as to inhibit the generation of imbalance forces when a fluid is applied to the cutting blades and the rigid member during a rotation of the cutting blades.

The invention relates, in another embodiment, to a fluid composition facilitating the operation of a cutting blade for cutting a semiconductor device. The fluid composition includes water; and an amount of lubricant configured to lubricate the cutting blade and to facilitate the removal of material from the cutting blade during the cutting of the semiconductor device.

The invention relates, in another embodiment, to a system for cutting semiconductor devices. The system includes cutting blades for cutting a semiconductor device. The system also includes annular rigid spacers separating adjacent ones of the cutting blades. The spacers each having an inner surface at its inner radius and an outer surface at its outer radius, and each contacting the adjacent ones of the cutting blades on first and second substantially planar surfaces each extending substantially from the inner surface to the outer surface. The system further includes a fluid reservoir. The system additionally includes an elongated member in movable proximity to the cutting blades. The elongated member is in fluid communication with the fluid reservoir and has channels configured to at least partially surround the cutting blades so as to simultaneously direct flow of a fluid from the fluid reservoir onto the cutting edges of the cutting blades and onto the sides of the cutting blades. Moreover, the system includes an adjustment mechanism configured to move the elongated member so as to adjustably align the channels with the cutting blades. The system may additionally include a pin-less nest fixture.

BRIEF DESCRIPTION OF THE DRAWINGS

The invention may best be understood by reference to the following description taken in conjunction with the accompanying drawings in which.

DETAILED DESCRIPTION OF THE INVENTION

The present invention generally relates to improved systems and methods for singulating a substrate into a plurality of integrated circuit devices (e.g., dies, unpackaged chips, packaged chips, and the like). The system is capable of overcoming the drawbacks mentioned above. Particularly, reducing blade breakage, improving cut quality, decreasing part movement, enabling higher feed rates, extending blade life and increasing throughput. The system described herein is particularly suitable for singulating leadless packages such as QFN. Although directed at leadless packages, the system is also suitable for singulating other surface mount devices such as chip scale packages, ball grid arrays (BGA), flip chips, and the like.

One aspect of the invention corresponds to a fixture that holds the substrate during the dicing process. The fixture includes a nest that eliminates the presence of locator pins, which can prevent debris from exiting the cutting area, i.e., the debris gets trapped between the pins and the blade.

Another aspect of the invention pertains to a nozzle assembly that provides better fluid flow over the cutting blades. The nozzles of the nozzle assembly direct fluid over an extended portion of the leading edge of the blade and also around the sides of the blade. The nozzles also helps puddle the fluid around the blade for longer periods of time and helps prevent fluid from being scattered away from the blade. In so doing, the blade is kept cooler and better lubricated thereby producing better cuts, reducing blade wear or breakage and allowing feed rates to be higher.

Another aspect of the invention corresponds to a nozzle adjustment assembly that helps position the nozzles relative to the blades. For example, the nozzle adjustment assembly may help align the nozzles to the centerline of the blade thereby helping distribute the fluid evenly over the blades as well as to keep the nozzles from contacting the blade.

Another aspect of the invention corresponds to spacers that reduce the problem of imbalance caused by fluid retained therein. The spacers are configured without a raised edge thereby eliminating the gap or cavity formed between the spacer and the blade. As a result, the fluid cannot pool inside the gap or cavity.

Yet another aspect pertains to the composition of the fluid, which is distributed by the nozzle assembly to the blades.

For example, the composition of the fluid may be configured with additives that aid in lubrication during the dicing process.

Embodiments of the invention are discussed below with reference to FIGS. 3-14. However, those skilled in the art will readily appreciate that the detailed description given herein with respect to these figures is for explanatory purposes as the invention extends beyond these limited embodiments.

Figure 3:
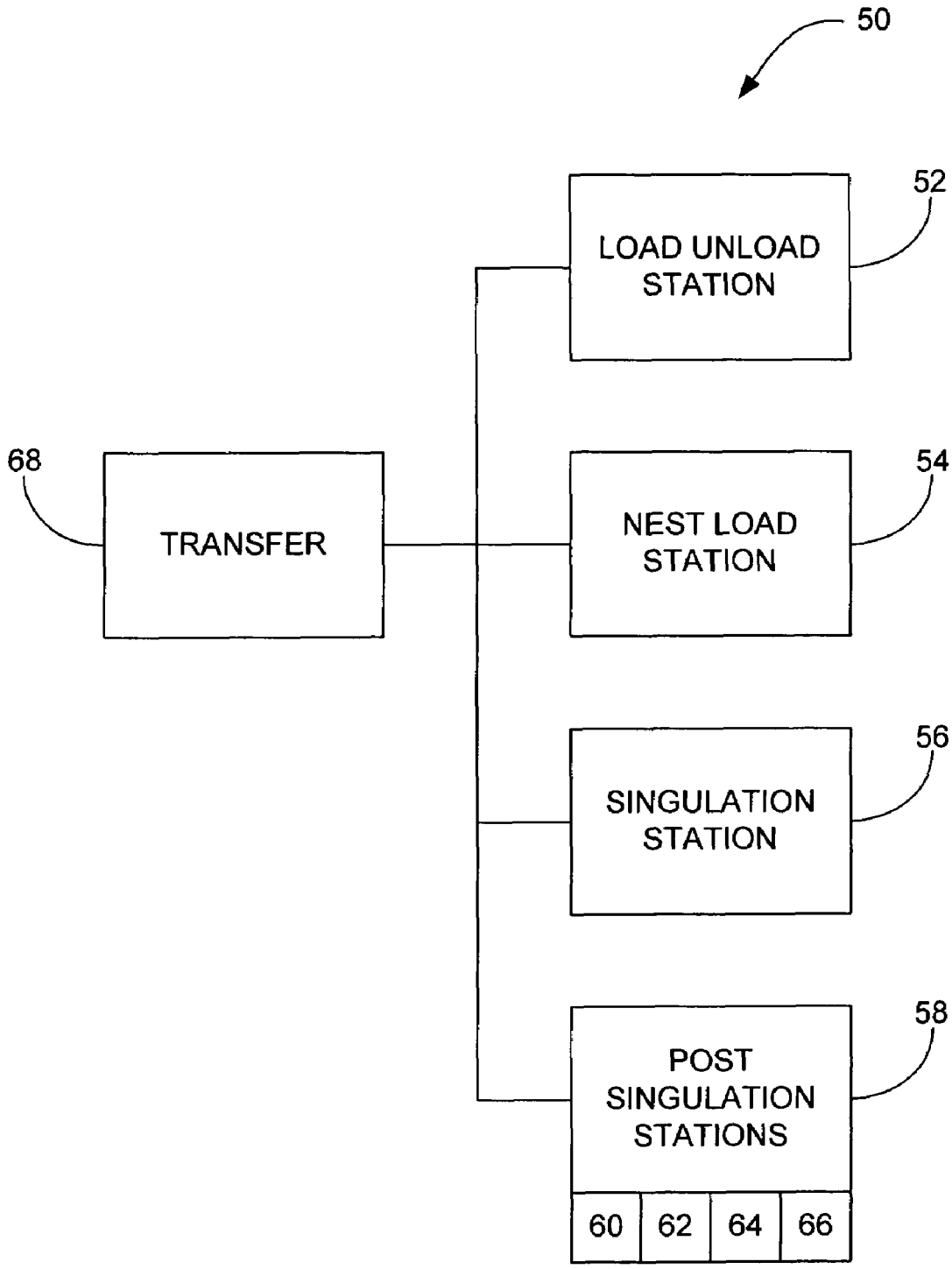
FIG. 3 is a simplified block diagram of a substrate processing system, in accordance with one embodiment.

FIG. 3 is a simplified block diagram of a substrate processing system 50, in accordance with one embodiment. The substrate processing system 50 may be used to process packaged devices contained on a strip, carrier or substrates of various types including circuit boards, film, metal on ceramic based substrates, and the like. By way of example, the substrate processing system 50 may be used to process QFN devices.

The substrate processing system 50 generally includes a load/unload station 52, a nest load station 54, and a singulation station 56. The load unload station 52 is the place where unprocessed substrates are received by the system and where processed substrates are removed from the system 50. The nest load station 54 is the place where the substrates are positioned on a nest that carries the substrate through various processing steps. The singulation station 56 is the place where the substrates are separated into a plurality of integrated circuit packages. For example, a dicing procedure may be performed.

The system 50 may also include post singulation stations 58 where the singulated packages are further processed. The post singulation stations 58 may be widely varied. For example, the post singulation stations 58 may include buffer stations 60, cleaning stations 62 (wash and dry), positioning stations 64, inspection stations 66 and/or the like.

Buffer stations 60 generally relate to areas used to store the packages between two different processing steps. For example, a buffer station may be used to store packages after singulation, but before cleaning. Cleaning stations 62 generally relate to areas where the packages are washed and dried. As should be appreciated, particles or debris may adhere to the singulated packages and thus they need to be cleaned. Positioning stations 64 generally relate to areas used to reposition the packages, as for example, for grouping packages together, for dividing them or for moving them to a desired location. Inspection stations 66 generally relate to areas where the substrate and/or packages are inspected. By way of example, visual inspection of the packages may be performed with a visual inspection system that includes a camera.

The system 50 may also include a transfer unit 68 including one or more transfer mechanisms (e.g., robots, stages, etc.) for transporting the substrate between the various stations for example between the load/unload station 52 and the nest load station 54, between the nest load station 54 and the singulation station 56, between the singulation station 56 and the post singulation stations 58, and between the post singulation stations 58 and the load/unload station 52 or nest load station 54.

Figure 4:
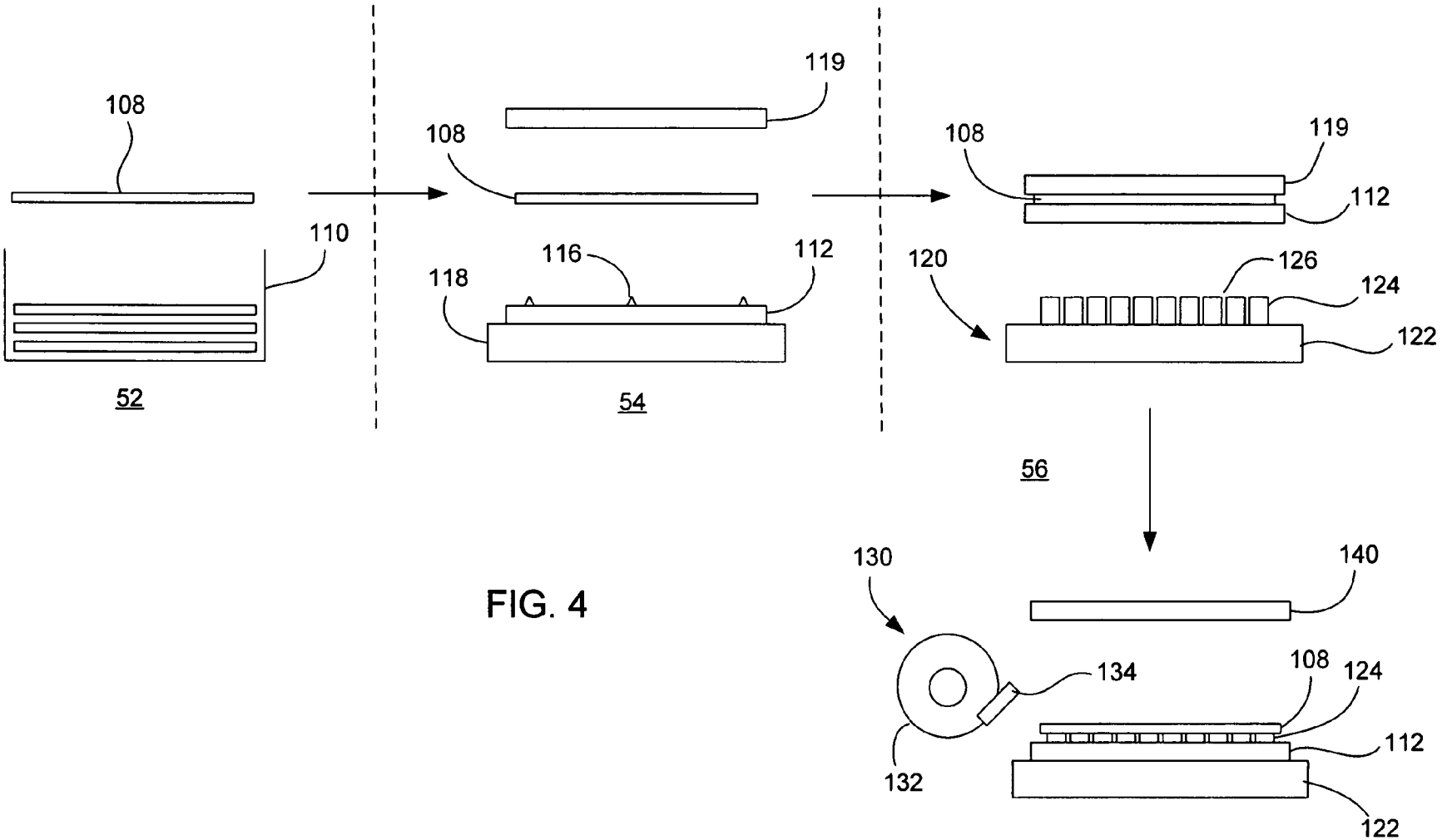
FIG. 4 is an illustration showing a process utilizing the system described in FIG. 3, in accordance with one embodiment of the present invention.

Referring to FIG. 4, a process utilizing the system 50 will be described in greater detail. As shown, a cassette 110, containing a plurality of substrates 108, is placed in the load portion of the load/unload station 52 and thereafter each of substrates 108 is fed to the nest load station 54. By way of example, an individual substrate 108 may be fed to the nest load station 54 via a pick and place machine (or similar carrier).

Once the substrate 108 is in the nest load station 54, the individual substrate 108 is loaded onto a nest 112. The nest 112 may for example be one of the nests shown and described in U.S. Pat. Nos. 6,187,654 and 6,325,059, which are herein incorporated by reference. These nests include locator pins 116 attached thereto that help align the substrate to the nest. The locator pins are received by locator holes in the substrate. Alternatively and as shown in FIG. 4, the nest 112 may be a pin-less nest that does not include locator pins thereon, but rather locator holes that temporarily accept locator pins 116 therethrough. The locator pins 116 are temporarily positioned through the locator holes so that the substrate 108 can be aligned to the nest 112. Once aligned, the locator pins 116 are removed from the locator holes (or vice versa). This is done to keep the locator pins 116 from interfering with the dicing process. For example, they may impede the motion of the cutting device or they may trap scrap material around the cutting blade, which can cause blade breakage.

To elaborate, the locator pins 116 are positioned on a pre-stage pin holder 118 rather than the nest 112. As such, the pins 116 do not interfere during singulation because they stay with the prestage pin holder 118 located within the nest load station 54 and not with the nest 112. The nest 112, however, does include corresponding locator holes for receiving the locator pins 116. These, however, do not cause problems during singulation as they do not mate with substrate 108 during singulation and they do not extend upwards in front of the cutting device. When the nest 112 is placed on the pin holder 118, the locator pins 116 pass through the locator holes and extend or protrude out of the nest 112. The locator pins 116 thereby perform their aligning function as if they were permanently positioned on the nest 112.

Once the substrate 108 is correctly positioned on the nest 112 and typically before the locator pins 116 are removed, a cover 119 is placed over the substrate 108 and nest 112 in order to secure the substrate 108 in its aligned position. The cover 119 may provide a force that sandwiches the substrate 108 between the nest 112 and the cover 119, thereby preventing the substrate 108 from moving out of the aligned position. Once the substrate 108 is aligned and secured to the nest 112, the pins 116 are removed. Thereafter, the covered nest 112 is loaded into the singulation station 56. By way of example, covered nest 112 may be loaded by a transfer mechanism (or similar carrier) that picks up the covered nest 112, and moves it to the singulation station 56.

Once in the singulation station 56, the substrate 108 is placed on a chuck 120. The chuck 120 is configured to receive the nest 112 and provide a vacuum in order to hold the substrate 108 and diced packages before during and after a cutting sequence. In one configuration, the chuck 120 includes a vacuum retainer plate 122 and a plurality of vacuum pedestals 124. The vacuum pedestals 124 extend above the vacuum retainer plate 122, and are separated by cutting channels 126 sized to receive the cutting blade(s). When the nest 112 is placed on the vacuum retainer plate 122, the vacuum pedestals 124 protrude through the nest 112 thereby raising the substrate 108 above the upper surface of the nest 112. Each of the vacuum pedestals 124 typically passes through an individual grid opening in the nest 112. The number of openings and vacuum pedestals generally corresponds to the number of packages located on the substrate. The top surface of the vacuum pedestal 150 forms a vacuum seal with the smooth undersurface of the package to be cut, allowing the package to be held securely to the top surface of the vacuum pedestal 124 when the vacuum is turned on. The suction force is generated through vacuum ports in each of the vacuum pedestals 124. Once the nest 112 is positioned on the chuck 120, the cover 119 can be removed from the nest 112 in order to prepare for a cutting operation.

During the cutting operation, the substrate 108 is separated into a plurality of individual packages via one or more sawing devices 130. Each of the sawing devices 130 includes one or more cutting blades 132, each of which is sprayed with a fluid to help cool and lubricate the blades 132 while cutting. The fluid is typically sprayed with one or more nozzles 134. The nozzles may be tubes, pipes or other similar article. There is generally a nozzle for each cutting blade. The nozzles may be separate and distinct from one another, or alternatively they may be integrated into a single integral member. The cutting blades 132 are arranged to rotate about an axis 136, and to translate through the substrate 108 in order to dice the substrate 108 into its individual pieces. During translation, the saw blades 132 are positioned within the cutting channels 126 between the vacuum pedestals 124. Because the substrate 108 is raised slightly above the top surface of the nest 112, the saw blades 132 protrude below the thickness of the substrate 108 without risking damage to either the nest 112 or the saw blade 132.

The sawing devices 130 and chuck 120 can be moved in a variety of ways in order to effect singulation of the substrate 108. Each of these components can be translated to drive the blades 132 through the substrate 108, and each of these components can be rotated so that orthogonal cuts can be made in the substrate 108. By way of example, a robot assembly may be configured to move the sawing devices and a stage may be configured to move the chuck. In embodiments where a single sawing device 130 is used, the sawing device or the chuck can be rotated (e.g., 90 degrees) so that the substrate can be cut in two directions (e.g., x and y). In embodiments where two sawing devices 130 are used, one of the sawing devices is positioned in a first orientation in order to cut the substrate 108 in a first direction (e.g., along the x axis) and the other sawing device 120 is positioned in a second orientation in order to cut the substrate 108 in a second direction (e.g., along the y axis). The chuck is typically rotated after a first set of cuts is made with the first sawing device so that a second set of cuts can be made with the second sawing device.

During one particular cutting operation, a first saw is lowered into a cutting position. For example, a robot moves the first saw device in the z direction until the blades reach a desired cutting height, which is generally very close to the substrate. The cutting blades are then rotated at the desired cutting speed, and coolant and/or lubricant is sprayed on the blades. Thereafter, the chuck is translated so as to pass the substrate through the blades. The chuck may make one pass and then step in order to make another pass through the cutting blades until all the desired cuts are made. After completing the first set of cuts, the cutting blades and spray nozzle are turned off and the first saw is raised. Thereafter, the chuck is rotated 90 degrees. After rotation, a second saw is lowered into a cutting position. For example, a robot moves the second saw device in the z direction until the blades reach a desired cutting height, which is generally very close to the substrate. The cutting blades are then rotated at a desired cutting speed, and coolant and/or lubricant is sprayed on the blades. Thereafter, the chuck is translated so as to pass the substrate through the blades. The chuck may make one pass and then step in order to make another pass through the cutting blades until all the desired cuts are made. Because the first and second cuts are orthogonal, the packages are effectively singulated from the substrate. As should be appreciated, if the blades are spaced equally at each sawing device, square parts will be produced, and if the blades are spaced differently, rectangular parts will be produced.

After the substrate 108 is diced into its parts, a top cover 140 is placed over the nest 112 containing the cut dies of the substrate 108 and the vacuum is turned off. The top cover 140 typically has contact posts, which hold down each individually separated package. The combination of the top cover 140, the nest 112 and the cut packages located therebetween forms a covered nest fixture. By lifting the covered nest fixture off of the chuck 120, the individual packages are permitted to drop back down to the nest surface (no longer secured by vacuum) where they are retained by walls that surround the openings in the nest 112. The retainer walls securely hold each cut package by their edges thereby preventing the translational and rotational motion of the cut package. The cut packages, which are held substantially immobile by the retainer walls, as well as trapped between the contact posts of the top cover and the nest 112, may now be further processed (e.g., washing, rinsing, drying) without incurring any movement. Furthermore, because the packages are held substantially immobile by the retainer walls, the diced packages are essentially aligned and ready to be removed from the nest 112 when the top plate 140 is finally removed, as for example, using a pick and place machine.

Figure 5:
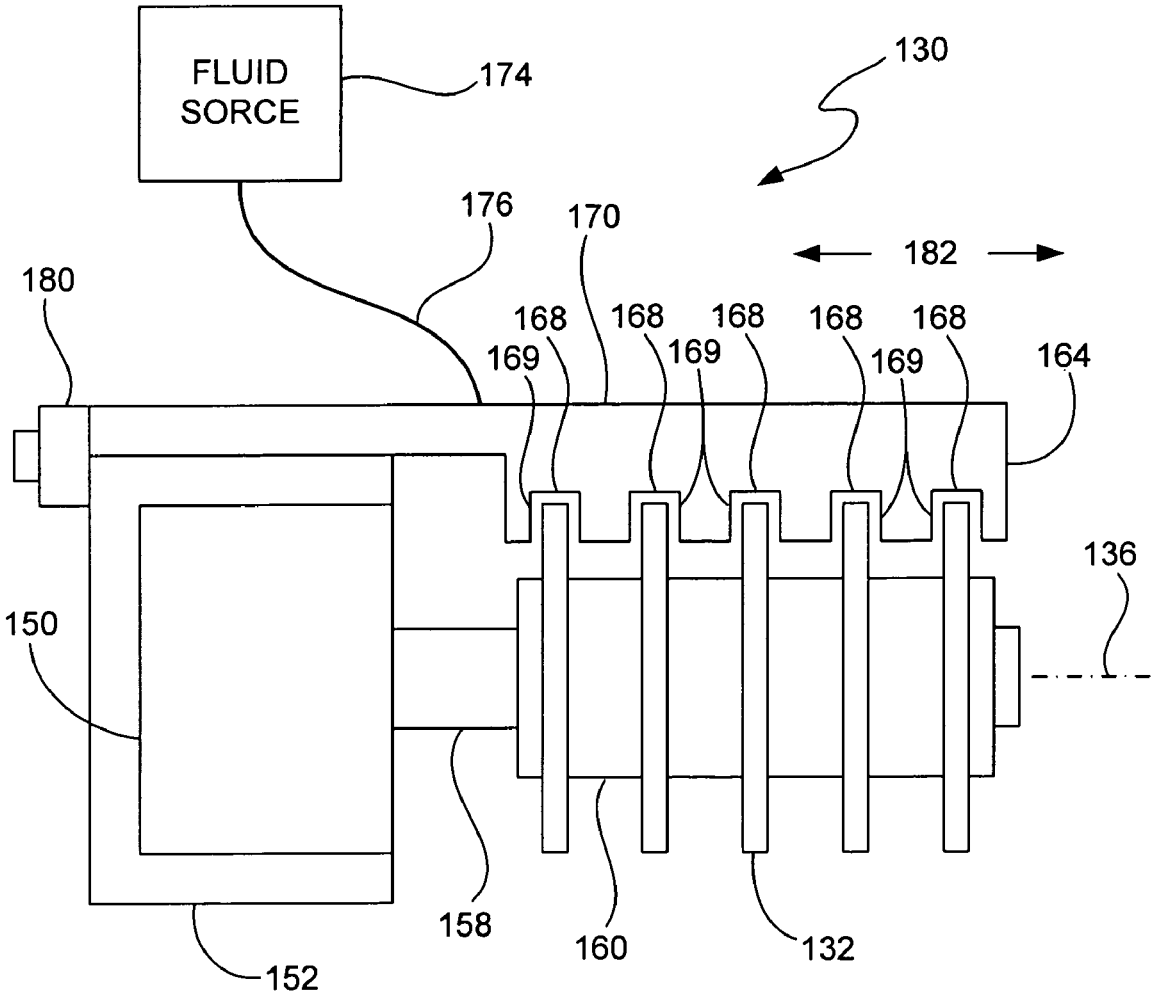
FIG. 5 is a diagram of a sawing device, in accordance with one embodiment of the present invention.

Referring to FIG. 5, the sawing device 130 will be described in greater detail. The sawing device 130 generally includes a motor 150 having a spindle 158 that rotates about the axis 136 to provide rotation for the cutting blades 132. The cutting blades 132 are attached to the spindle 158. The spindle 158 includes one or more spacers 160 that are configured to spatially separate the blades 132 and to hold the cutting blades 132 so that they do not slip when cutting. The spacers 160 and blades 132 are typically locked in place by a locking nut that provide an axial force along the axis 136 thereby sandwiching the spacers 160 and blades 132 together. In most cases, the motor 150 is attached to a spindle housing 152, which may be coupled to a transfer mechanism configured to provide motion to the sawing device(s) 130.

Any number of blades 132 may be used. In general, more blades 132 equates to a decreased cycle time. Therefore, a plurality of cutting blades 132 is preferably used in parallel in order to decrease the cycle time of the system. For example, the saw 130 may include two or more cutting blades 132 positioned side by side with gaps therebetween corresponding to the desired width of the singulated packages. This is sometimes referred to as "pitch." In some cases, the number of blades 132 corresponds to the number of packages located in the rows or columns on the substrate 108. For example, in a ten by ten array the saw assembly 130 may include at least 10 blades 132. This is not a requirement, however, and the number of blades 132 may vary according to the specific needs of each device, i.e., there may be fewer blades 132 than rows of packages or there may be more blades than rows of packages. In the case where there are fewer blades 122 than packages, the system may be arranged to make more than one pass in order to complete the cutting of the substrate 108 in the specified direction.

The sawing devices 130 also include a spray nozzle assembly 164 for spraying coolant or lubricant on each of the blades 132. The coolant or lubricant may for example correspond to water. The spray nozzle assembly 164 generally includes a spray nozzle 168 for each cutting blade 132.

The sprays nozzles 168 are fluidly coupled to a fluid source 174 via one or more hoses 176 so as to distribute the fluid to the blades 132. In some cases, each of the spray nozzles 168 is a separate and distinct component. In other cases, the spray nozzles 168 are ganged together and integrally formed as single part. In either case, each of the spray nozzles 168 may be fluidly coupled to a central manifold 170 that receives the fluid from the hoses 176 and directs the fluid through each of the spray nozzles 168.

In one embodiment, each of the spray nozzles 168 includes a channel 169 configured to at least partially surround the cutting blade 132, so as to simultaneously direct flow of a fluid onto the cutting edge of the cutting blade and onto the sides of the cutting blade. The spray nozzle may, for example, include sides walls and/or bottom walls that surround the cutting blade when the cutting blade is in the channel 169.

The spray nozzle assembly 164 is generally attached to the spindle housing 152 so as to precisely locate the nozzles 168 relative to the cutting blades 132. In some cases, the position of the spray nozzle assembly 164 is fixed relative to the blades 132, and in other cases the position of the spray nozzle assembly 164 is adjustable relative to the blades 132. In the later case, the spray nozzle assembly 164 may also be attached to the spindle housing 152 via a fine tune positioning device 180 that allows the position of the spray nozzle assembly 164 to be adjusted relative to the blades 132. By way of example, the spray nozzles 168 can be moved linearly along line 182 so as to center the nozzles 168 on the blades 132 thereby optimizing the fluid contact with the surfaces of the blade 132 as well as preventing the blades 132 from contacting the nozzles 168.

According to a first aspect of the invention, a pin less nest is provided. The pin less nest does not include any locator pins extending from the surface and thus the nest can be used in a cutting operation without worrying about it interfering with a saw device and without it trapping material between it and the cutting blades. That is, by removing the pins, the saw device can be placed in its desired position relative to the surface of the substrate, and further the substrate can be moved through the blades without having remnants of the substrate catching the pins, i.e., the remnants slide off rather than getting stuck between the pin and the blade.

Figure 6A:
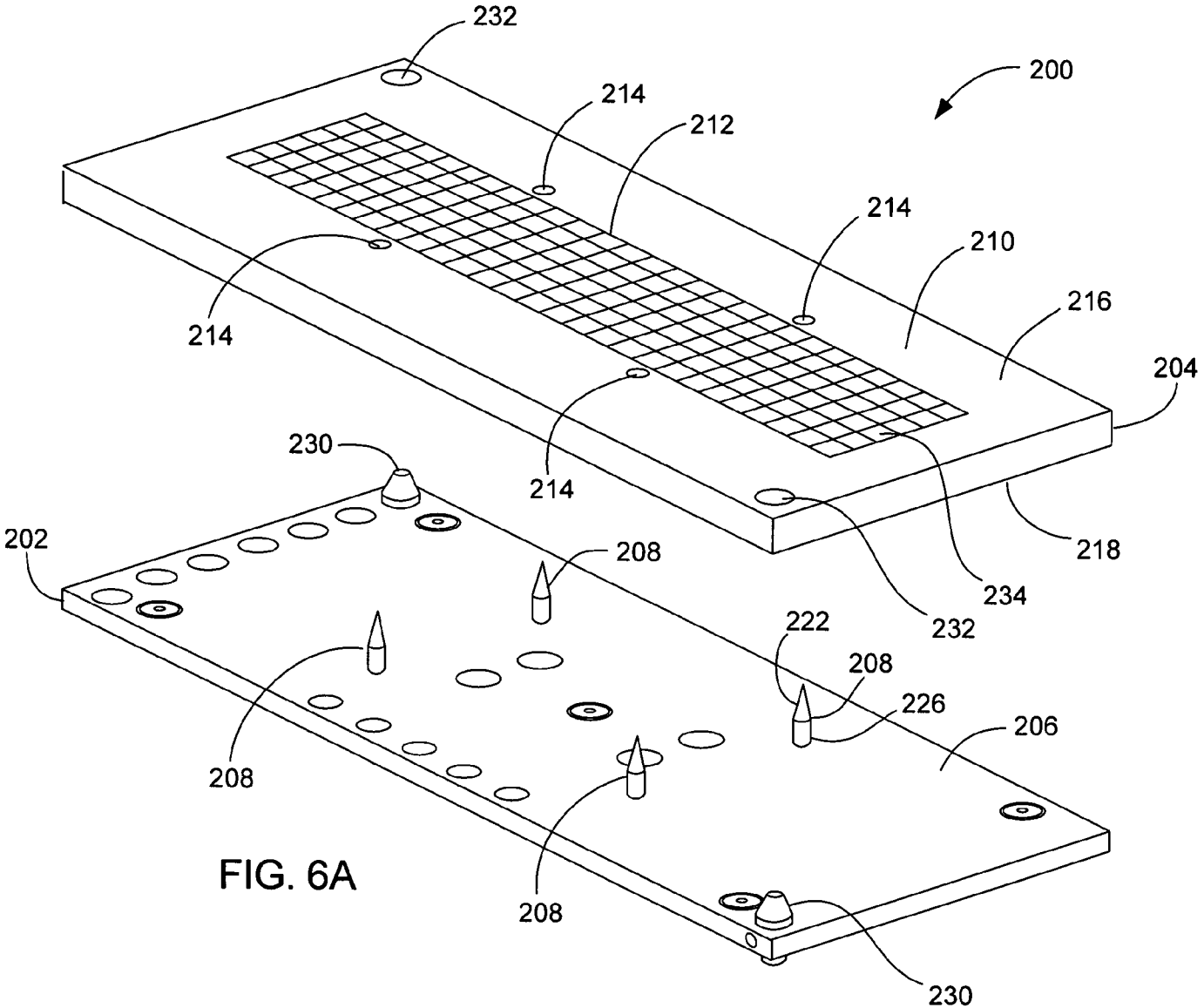
FIGS. 6A and 6B are perspective diagrams of the pin-less nest assembly, in accordance with one embodiment of the present invention.
Figure 6B:
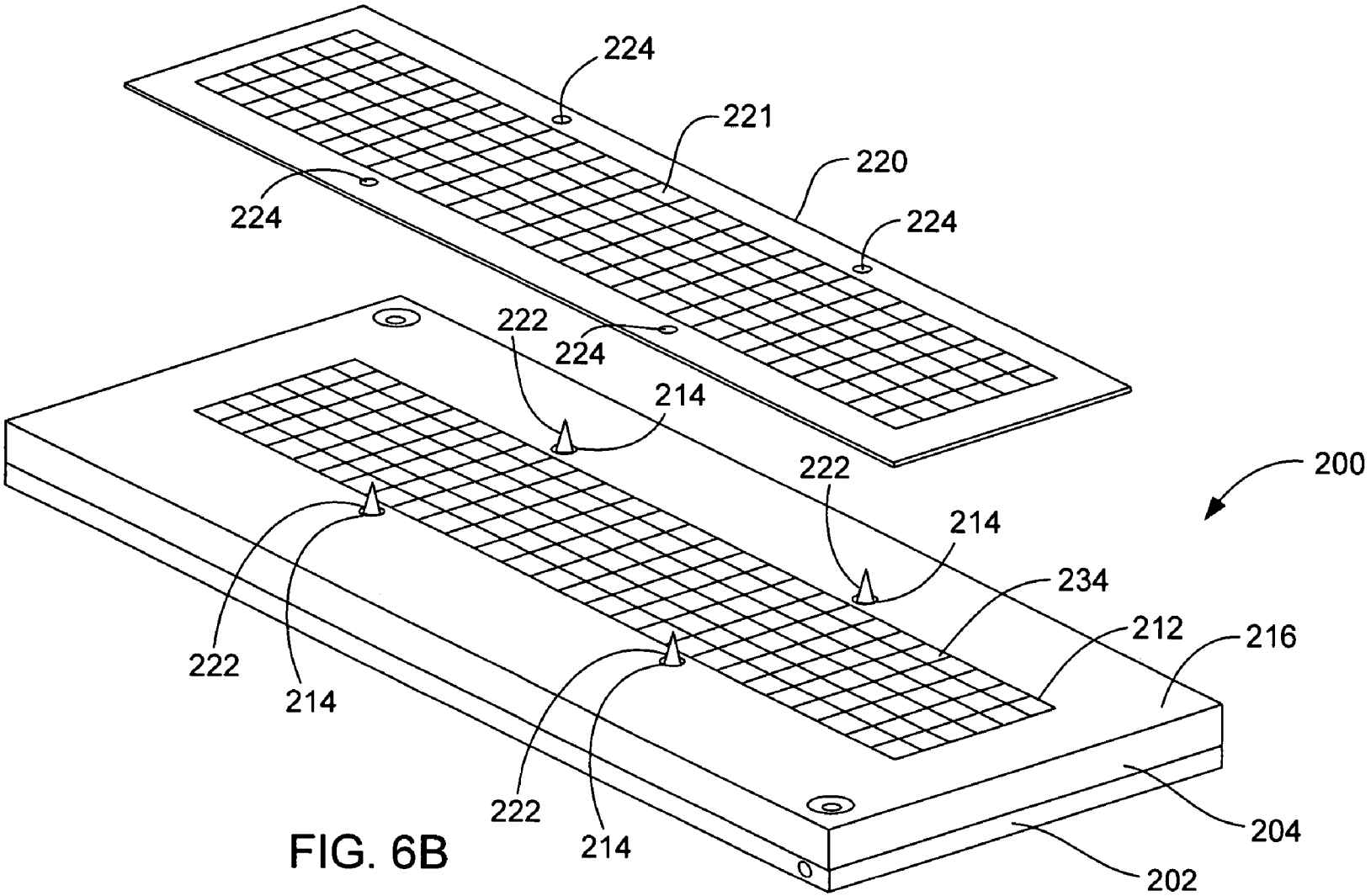

FIGS. 6A and 6B are perspective diagrams of the pin-less nest assembly 200, in accordance with one embodiment of the present invention. The pin-less nest assembly 200 generally includes a pin holder plate 202 and a nest 204 that is configured to temporarily mate with the pin holder plate 202. FIG. 6A shows the nest 204 separated from the pin holder plate 202 and FIG. 6B shows the nest 204 mounted on the pin holder plate 202. The pin holder plate 202 is located within a substrate loading area while the nest 204 is movable therefrom. That is, the nest 204 is used to transfer the substrate 220 and cut parts between various stations.

The pin holder plate 202 includes a receiving surface 206 and a plurality of locator pins 208 extending from the receiving surface 206. The nest 204 includes a support structure 210 that surrounds a grid arrangement 212. The support structure 210 includes a plurality of locator holes 214 that coincide with the locator pins 208 on the pin holder plate 202. When the nest 204 is placed on the pin holder plate (FIG. 6B), the bottom surface of the nest 218 engages the receiving surface 206 of the pin holder plate 202 and the locator pins 208 pass through the locator holes 214 and above the top surface 216 of the nest 204.

Because the locator pins 208 protrude above the top surface 216 of the nest 204 when the nest 204 and plate 202 are mated, the locator pins 208 can be used to properly position a substrate 220 on the nest 204 similarly to nests that include locator pins. That is, the top portion 222 of the locator pins 208, the portion that extends above the surface 216, can be placed within locator holes 224 located on the substrate 220, i.e., the top portion engages the locator holes on the substrate in order to position the substrate with respect to the nest. The number of locator pins typically varies according the desired needs of each system. The top portion 222 may include a tapered section that helps guide the locator holes 224 over the base 226 of the locator pin 208. The base 226 generally has a size and dimension that coincides with the size and dimension of the locator holes 224. The substrate 220 is therefore exactly positioned relative to the nest 204, i.e., no lateral shifts. Alternatively, the tapered section may include a portion that coincides with the size and dimension of the locator holes.

In order to properly align and support the nest 204 on the pin holder plate 202, the pin holder plate 202 also includes one or more pilot locator posts 230 that are placed within pilot locator holes 232 on the nest 204. The pilot locator posts 230 may include a tapered section so as to help guide the pilot locator holes 232 over a base section of the pilot locator posts 230. The base section is sized and dimensioned similarly to the pilot locator holes so as to prevent shifts therebetween. The number of locator posts may be widely varied. In the illustrated embodiment, there are two pilot locator posts 230 placed at opposing corners of the plate 202. This configuration helps maintain the nest in a known x and y position. The pilot locator posts 230 as well as the locator pins 208 are typically press fit into voids in the plate 202.

Referring to the nest 204, the nest 204 is configured, or otherwise arranged, to translationally and rotationally reduce the movement of the substrate 220 and packages cut therefrom positioned within nest 204. When a substrate 220 is properly positioned with respect to nest 204, the substrate 206 rests against the grid arrangement 212. The grid arrangement 212 defines openings 234, which accommodate the packages 221 cut from the substrate 220. That is, the packages 221 of the substrate 220 are at least partially placed within the openings 234 after they are cut from the substrate 220. In most cases, the nest openings 234 have a footprint, which is of substantially the same shape as the packages 221. The number of openings 234 may be widely varied, but generally correspond to the number of packages located on the substrate 220. Each opening effectively "holds" one package.

To elaborate, the nest openings 234 are formed through the thickness of nest 204. The size of each nest opening 234 is dimensioned to be slightly smaller than the dimension of the package 221 to prevent the package 221 from falling through. In most cases, each nest opening 234 is surrounded by retainer walls (not shown), which are disposed on top surface of nest 204. Retainer walls are arranged such that a package can rest on the top surface of the nest 204 while overlying nest opening 234, yet have its edges retained within retainer wall to limit the translational and rotational movement of the individual package 221.

Once the substrate 220 is aligned with the nest 204, a cover (not shown) may be used to secure the substrate 220 to the nest 204 in order to maintain its proper position relative to the nest 204. The cover stays locked with the nest 204 during substrate transfer. The cover is removed when the nest 204 is positioned on the vacuum retainer plate and the vacuum is turned on thereby securing the substrate 220 to a vacuum chuck. The cover may for example include a pad including locator pins or holes for engaging corresponding pins and holes in the nest and/or the substrate. The pad also typically includes a mating surface for engaging the substrate, i.e., the mating surface is pressed against the substrate to hold the substrate against the nest.

Another aspect of the invention relates to the design of a nozzle for directing fluid over the cutting blades of a sawing device. The fluid flow acts to cool the blades, as well as to lubricate them so as to facilitate the cutting process. The fluid flow also acts to clean particulates from the blades and the substrate. As should be appreciated, unwanted byproducts such as heat and a substantial quantity of particulates are produced during the cutting process. More particularly, the nozzles described herein are configured to improve the flow rate and flow characteristics of the fluid around the blades so as to overcome the problems with current nozzle designs that often fail to adequately cool, clean, and lubricate the sides of the blades.

Figure 7:
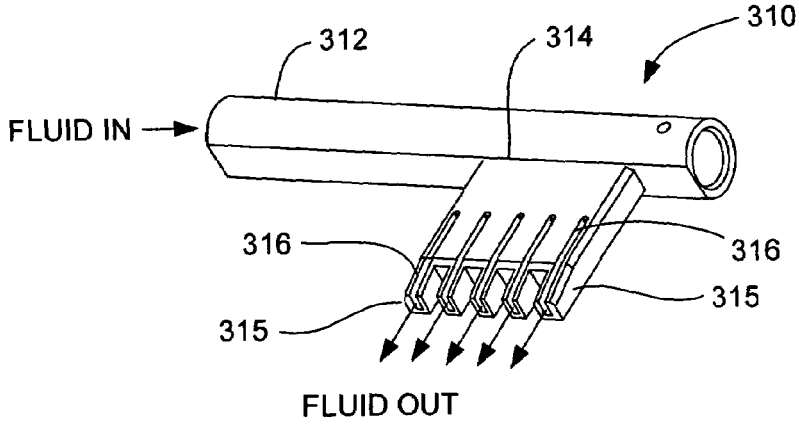
FIG. 7 is a perspective view diagram of a nozzle assembly, in accordance with one embodiment of the present invention.

FIG. 7 is a perspective view diagram of a nozzle assembly 310, in accordance with one embodiment of the present invention. The nozzle assembly 310 includes a pipe member 312 and a nozzle member 314. The pipe member 312 is configured to distribute fluid to the nozzle member 314, and the nozzle member 314 is configured to direct the fluid at each of the cutting blades. The nozzle member 314 includes a plurality of nozzles 315, each of which has a channel 316 formed therein. The channels 316 are fluidly coupled to the pipe member 312 and sized and dimensioned to receive a cutting blade. During operation, the channels 316 receive the fluid from the pipe member 312 and distribute the fluid around the cutting blade. That is, the fluid is directed through the pipe member 312 and into the nozzle member 314. Once in the nozzle member 314, the fluid is forced out through the channels 316 formed in each of the nozzles 315 and onto a cutting blade disposed in the channel 316.

Figure 8A:
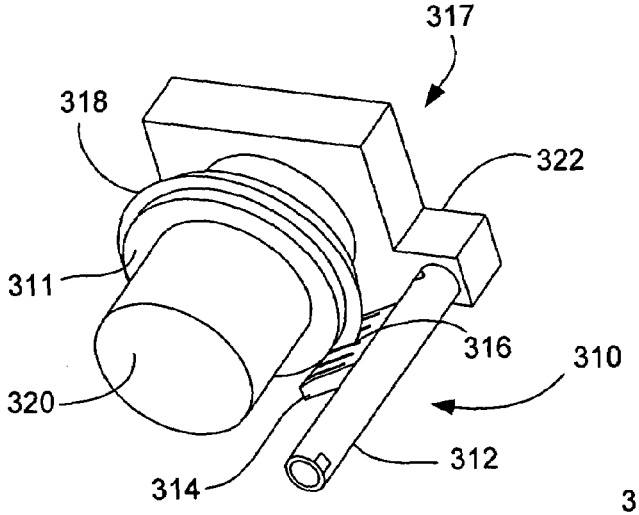
FIGS. 8A and 8B are isometric and side views, respectively, of a dicing assembly employing the nozzle assembly of FIG. 7, in accordance with one embodiment of the present invention.
Figure 8B:
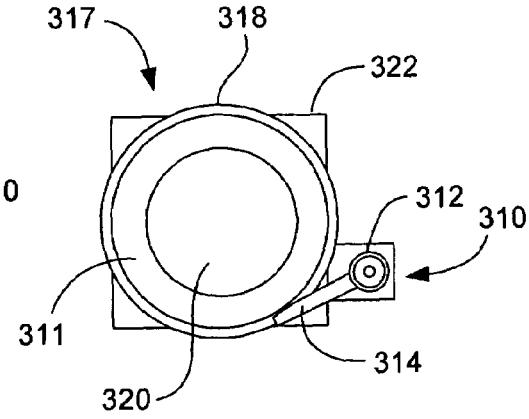

FIGS. 8A and 8B are isometric and side views, respectively, of a dicing assembly 317 employing the nozzle assembly 310 of FIG. 7. The dicing assembly 317 includes one or more cutting blades 318 that are separated by spacers 311 and affixed to a rotating spindle 320. The nozzle assembly 310, which can be attached to a spindle housing 322 of the dicing assembly 317, is positioned to receive each of the cutting blades 318, i.e., the cutting blades 318 are placed partially within the channels 316 of the nozzles 315. When the cutting blades 318 are rotating, fluid is forced through the pipe member 312 and out through the channels 316 of the nozzles 315. Because each of the nozzles 315 partially surrounds the blade 318 when the blades 318 are in the channels 316, fluid is forced along both the edge of the blade 318, as well as at least a portion of the sides of the blade 318. In this manner, more fluid contacts the blades 318 than with conventional nozzles. This results in improved cooling of the blades 318, as well as better removal of particulate matter and better lubrication.

Figure 9B:
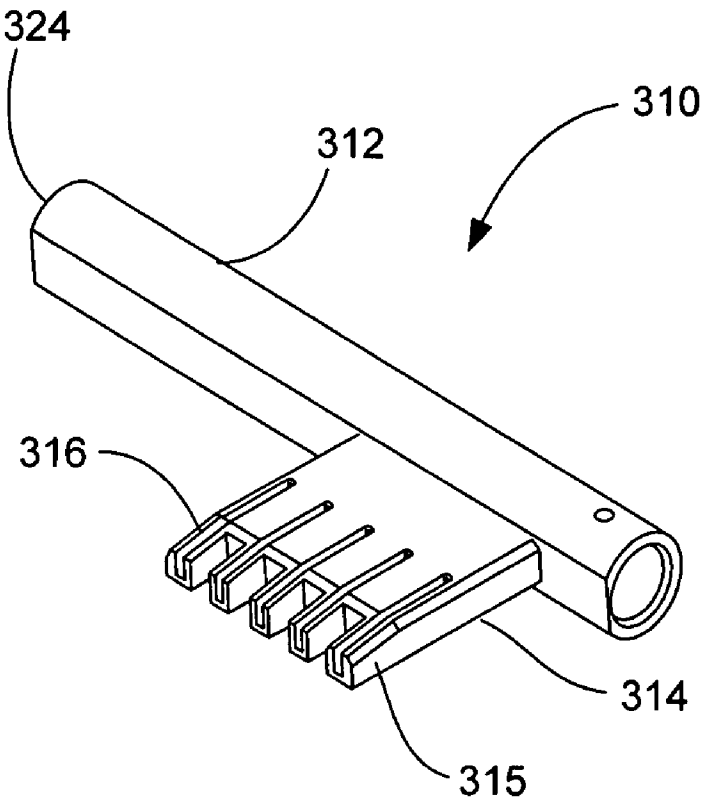
FIGS. 9A-9I are various diagrams of the nozzle assembly of FIG. 7, in accordance with one embodiment of the present invention.
Figure 9A:
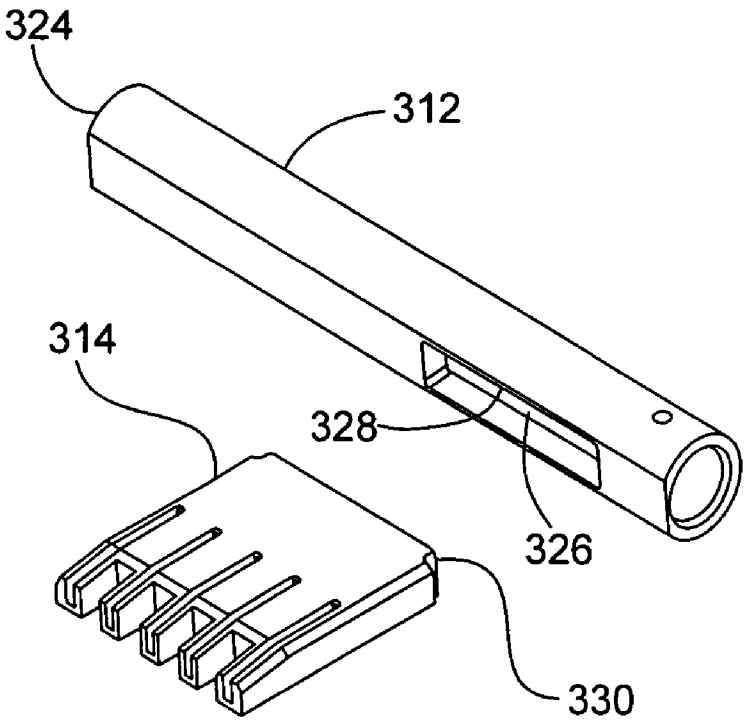

Referring to FIGS. 9A-9I a particular embodiment of the nozzle assembly 310 will now be described in detail. As shown in FIGS. 9A and 9B, the nozzle member 314 is attached to the pipe member 312 so as to form the nozzle assembly 310. The pipe member 312 includes an inlet 324 at one of its ends and a fluid passage 326 extending from the inlet 324 to an opening 328 in the side of the pipe member 312. The nozzle member 314 is attached to the pipe member 312 at the opening 328. The nozzle member 314 may include a fluid receiving end 330 that is sized and dimensioned for placement within the opening 328. Once in the opening, the nozzle member 314 is fixed and sealed to the pipe member 312 to form a single integrated unit. During operation, the inlet 324 is connected to a fluid source, and a fluid is forced through the fluid passage 326 and through the fluid receiving end 330 of the nozzle member 314 so as to force fluid out each of the channels 316 in the nozzles 315.

The nozzle member 314, which is shown as a single elongated member, can be fabricated from a stainless steel, but the invention contemplates the construction of nozzle members 314 made of any material compatible with the pipe member 312 and capable of withstanding the dicing environment. By way of example, other metals or plastics may be used instead of stainless steel. In embodiments in which the nozzle 314 and pipe 312 are made of metal such as stainless steel, the channels 316 can simply be cut through the body of the nozzle 314, and the back end 330 can simply be welded to the pipe 312 as for example at the interface between the nozzle member and the pipe member.

Figure 9E:
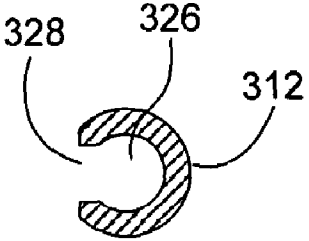
Figure 9C:
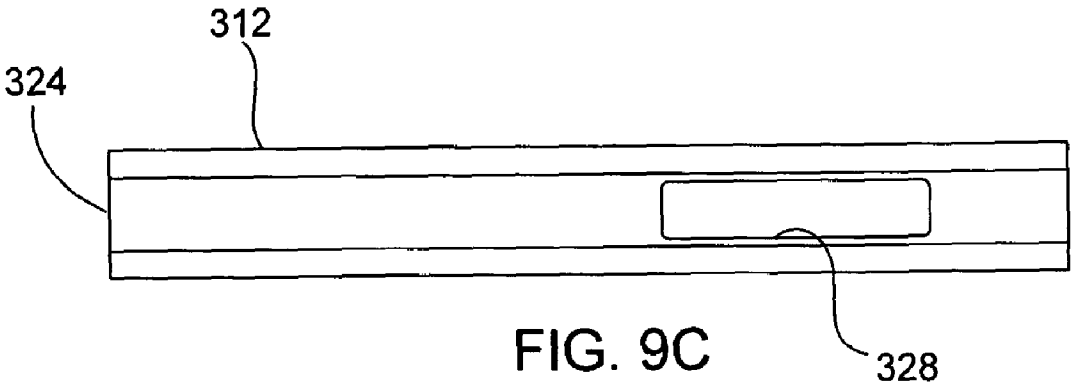
Figure 9D:
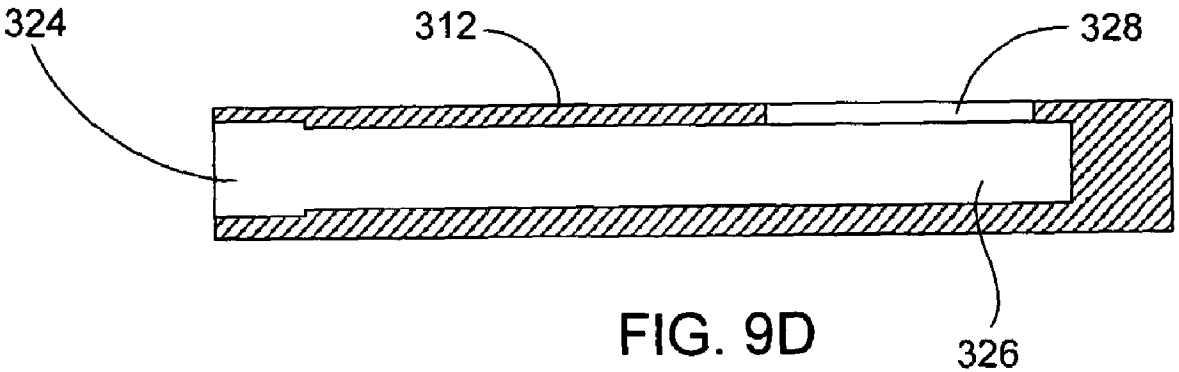
Figure 9F:
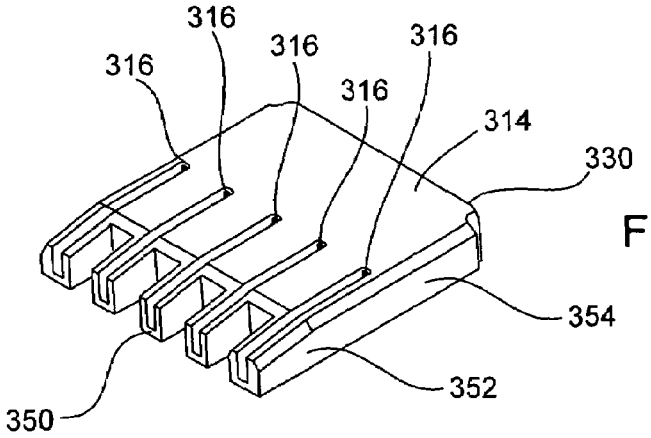
Figure 9G:
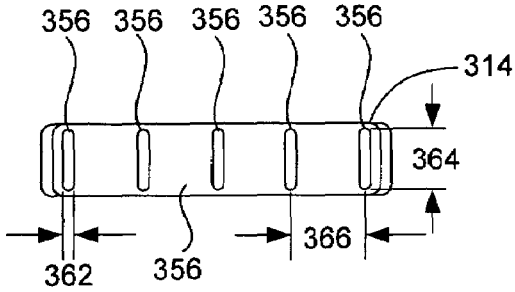
Figure 9H:
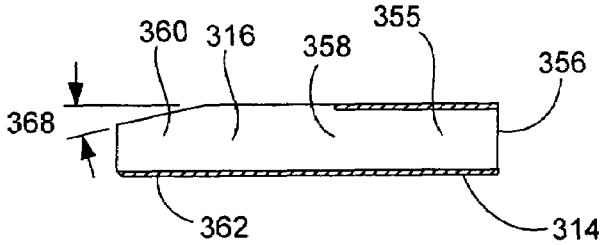
Figure 9I:
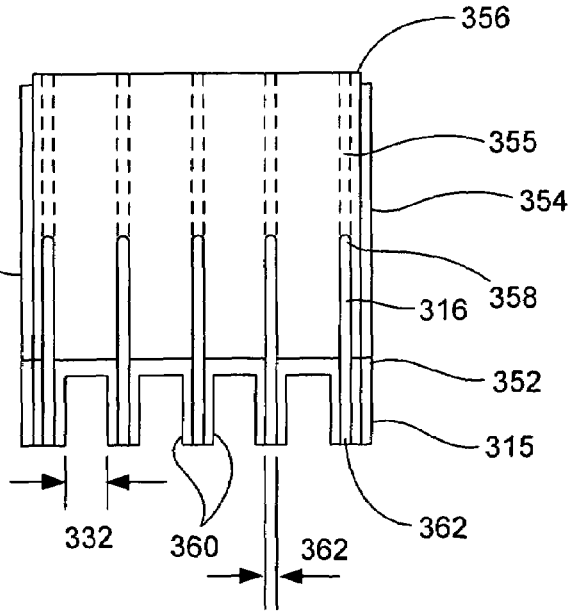

FIGS. 9C-9E illustrate various views of the pipe member 312 so as to explain its operation in further detail. The pipe member 312 is formed as a pipe that has a fluid passage 326 extending therethrough. The inlet 324 of the pipe member 312 is capable of receiving a fitting so that the pipe member 312 can be fluidly coupled to a fluid source. The end opposite the inlet is capped or otherwise blocked. The fluid flowing through the fluid passage 326 therefore is forced to exit through the opening 328 in the side of the pipe member 312. The side portion of the pipe member 312 that includes the opening 328 forms a planar surface so as to form a receiving surface for the nozzle member 314 when the end nozzle member 314 is inserted into the opening 328 in the pipe member 312.

FIGS. 9F-9I illustrate various views of the nozzle member 314 so as to explain its operation in further detail. The nozzle member 314 includes a plurality of integral nozzles 315 that are ganged together. Each of the nozzles 315 includes a blade receiving portion 352 and a fluid passage portion 354. The blade receiving portion 352 includes the channels 316. The fluid passage portion 354 includes a through hole, opening or slot 355 that directs fluid from the pipe member 312 to the channels 316 of the blade receiving portion 352. The slots 355 generally include an inlet 356 for receiving the fluid from the pipe 312 and an outlet 358 for distributing the fluid to the channels 316 of the blade receiving portion 352. Although not shown, in some cases, a cavity or reservoir may be disposed in front of all the inlets 356 between the inlets 356 and the pipe member 312 to help direct and equalize the flow through each of the slots 355. In some cases, the cross sectional area of the slots 355 is made greater than the cross sectional area of the holes in conventional spray nozzles (e.g., conventional nozzles have about $mm^2$). This allows the flow rate to be increased and therefore a greater volume of fluid to be distributed to the blades. As should be appreciated, more fluid typically increases both cooling and lubrication and also helps remove materials from the cutting area.

The channels 316 of the blade receiving portion 352 are each sized and shaped to accommodate a separate cutting blade 318. More specifically, each channel 316 has a width 362 sufficient to enclose a blade 318 within, and a depth 364 sufficient to direct fluid along the sides of the blade 318. The fluid is therefore not only directed at the edge of the cutting blade but also at the sides of the blade. To elaborate even further, the channels of the blade receiving portion 352 are formed by several walls including side walls 360 and a bottom wall 362. The side walls 360 and bottom wall 362 are configured to surround the blade thus helping to force fluid around the cutting blade, i.e., keeps the fluid in greater contact with the cutting blade (time, area, etc.). Fluid that would normally be deflected away from the blade using conventional nozzles is now redirected over the blade. A greater volume of fluid can therefore be used to flush the blade. The shape of the side walls and bottom walls may be widely varied. The may be rounded, stepped, angled or they may be straight or substantially planar (as shown). When planar, the side walls are substantially parallel with the blade.

Furthermore, the channels 316 and therefore the nozzles 315 are spaced a distance 366 apart from each other, corresponding to the distance between blades 318, or the width of a package. Further still, the blade receiving portion 352 of the nozzle 315 may include a sloped or tapered section to keep the nozzle 315 from interfering with portions of the dicing assembly. For example, an angle 368 may cut out from a front top portion of the nozzle 314 so as to keep the nozzle 314 from impinging upon the spacer 311 of the dicing assembly.

It should be noted that the embodiment shown in FIG. 9 is not a limitation and that it may vary according to the specific needs of each cutting operation. By way of example, in some cases, it may be desirable to eliminate the bottom wall of the channel thereby forming a cut out rather than a channel. This, however, is believed to not work as well as a nozzle having a bottom wall.

Figure 10:
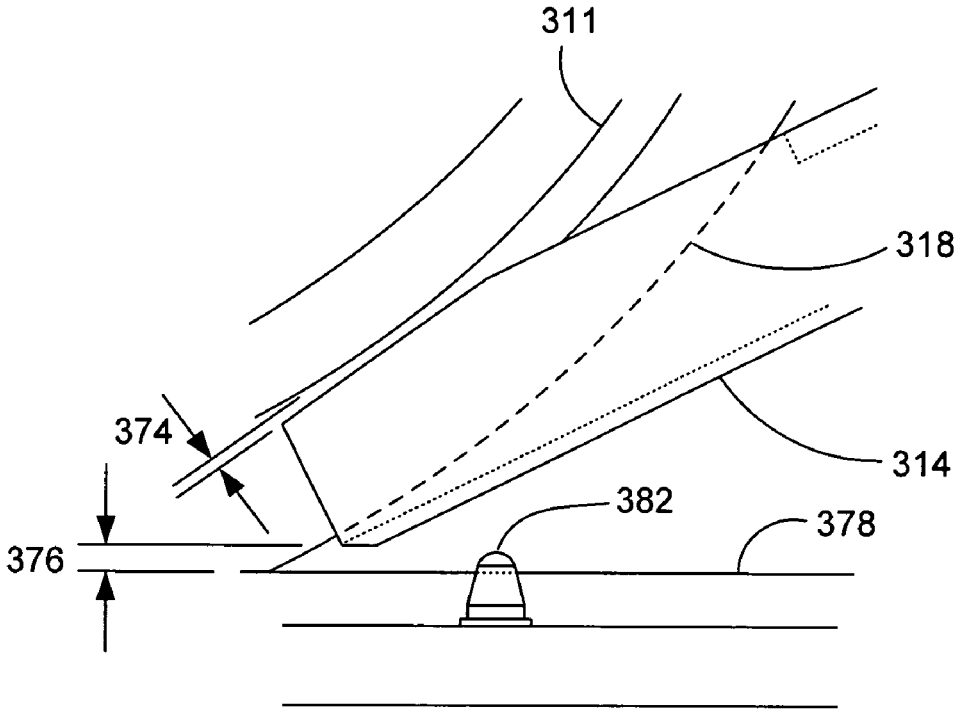
FIG. 10 illustrates further details of the nozzle of FIG. 7, in accordance with one embodiment of the present invention.

FIG. 10 illustrates further details of the nozzle 314 in operation. As described above, cutting blades 318 are placed within the channels 316 so that the nozzle 314 partially surrounds the cutting blade 318. Fluid is then directed through the channel 316 and onto the cutting blade 318. When the blade 318 spins to cut a substrate 378, heat is generated and particulate matter is produced. The fluid acts to lubricate the blade 318, and remove both the generated heat and particulate matter from the edges and sides of the blade 318.

In order to more effectively direct fluid onto the blade 318, the nozzle 314 is configured so that its channels 316 surround the blade 318 while satisfying the various spatial constraints of the dicing process. For instance, the angle 368 is designed so as to allow a clearance 374 between the nozzle 314 and spacer 311. This prevents the nozzle 314 from touching the spacer 311, and also allows space for fluid to flow out of the channel 316 onto the blade 318. Similarly, the nozzle 314 is designed with a clearance 376 so as to prevent it from scraping against substrate 378 during dicing. The clearance 376 and/or the width of the nozzle 315 also keep the nozzle 315 from contacting any locating pins 382 that are commonly used to locate the substrates 338 during dicing.

Figure 11:
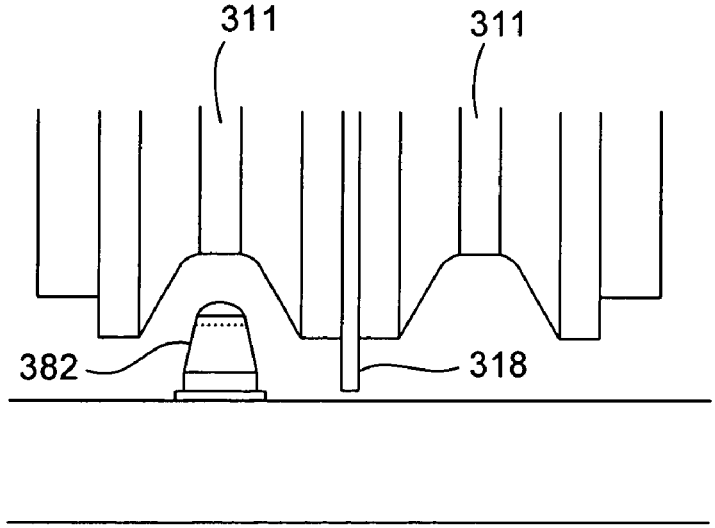
FIG. 11 illustrates a view orthogonal to that of FIG. 10, in accordance with one embodiment of the present invention.

FIG. 11 illustrates a view orthogonal to that of FIG. 10, in which it can be seen that the locating pins 382 provide yet another design constraint as for example when a conventional nest is used rather than the pin-less nest described above. Specifically, as the locating pins 382 are often placed between blades 318, the nozzles 314 are designed with cutouts 332 that prevent contact with the pins 382 during dicing (cut outs 332 can be seen in FIG. 9I).

Another aspect of the invention involves the composition of the fluid used during dicing. As described above, a fluid is pumped through the pipe 312 and channels 316 of a nozzle 314, so as to cool, clean, and lubricate the blade 318. This fluid can simply be water. However, the presence of certain additional compounds acts to enhance the desired properties of the fluid. Thus, the invention contemplates the addition of any compounds that act to enhance the cooling, lubricating, or particulate removal capabilities of fluid used in dicing. For example, the addition of known soap or other cleaning solutions acts to improve both the lubricating and cleaning abilities of the fluid. The addition of lubricants such as those manufactured by Mirachem™ or Castrol™ also acts to improve lubrication. The invention therefore contemplates the addition of these and any other compounds that modify the properties of fluid so as to improve the dicing process.

Another aspect of the invention involves finely positioning the spray nozzles relative to the cutting blades. This may be done to better center the nozzles and thus the fluid stream on the blades so that the fluid is more equally delivered to each of the blades.

Figure 12B:
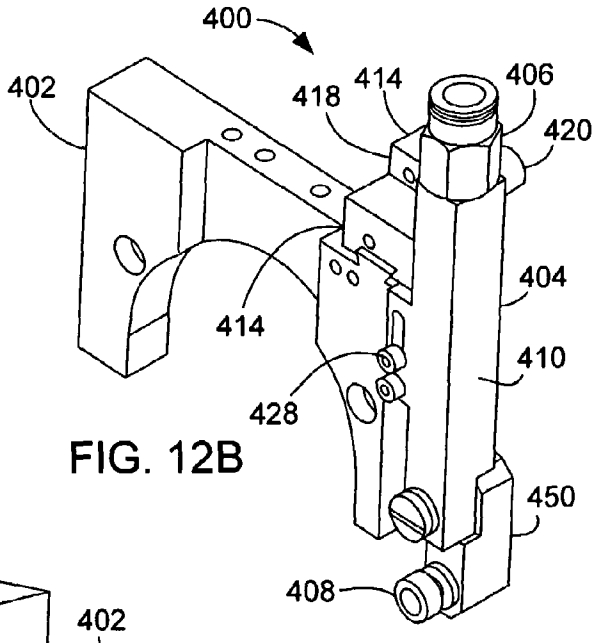
FIGS. 12A-C are a diagrams of a nozzle adjustment assembly, in accordance with one embodiment of the present invention.
Figure 12A:
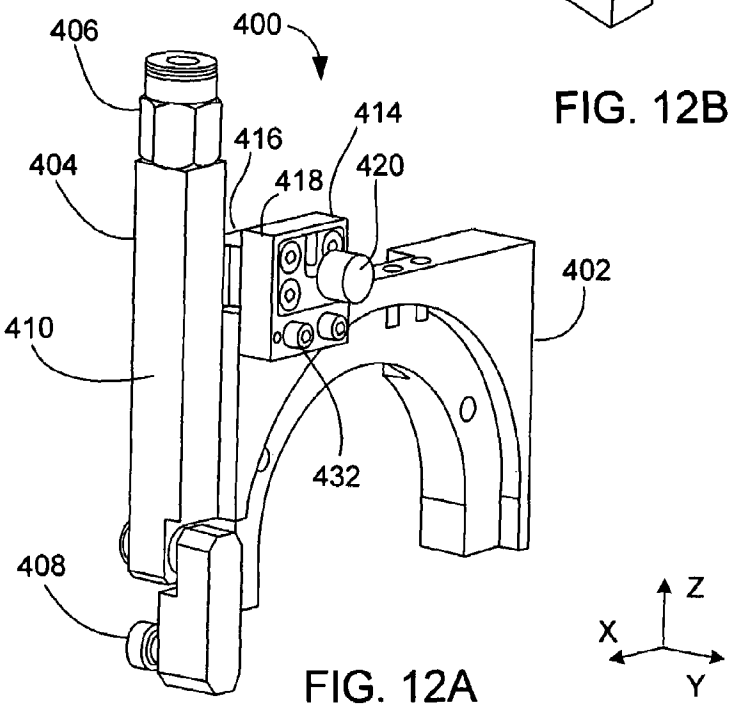
Figure 12C:
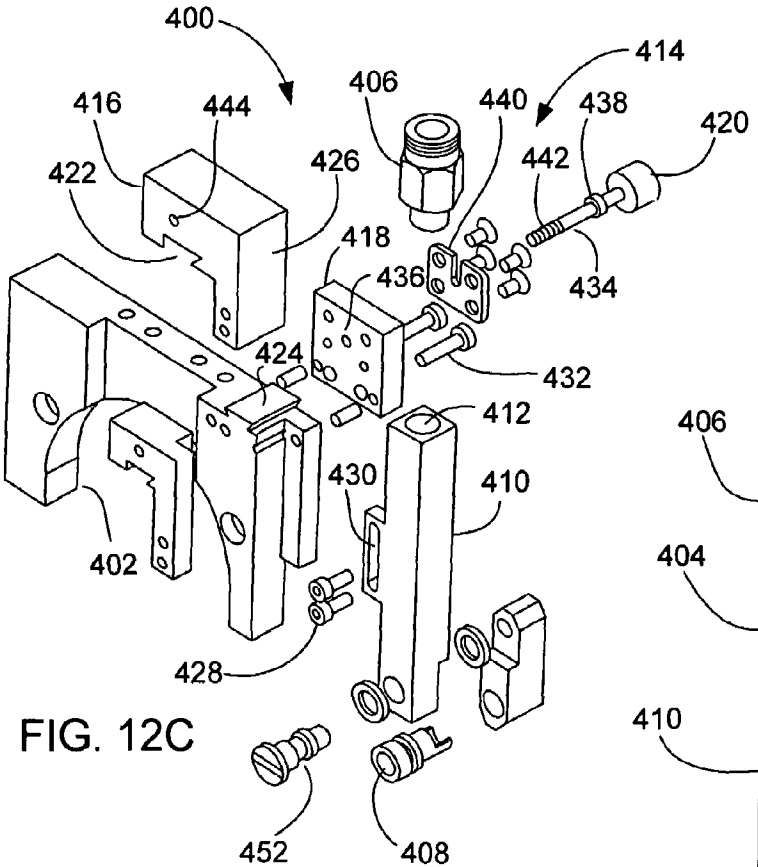

FIGS. 12A-C are a diagrams of a nozzle adjustment assembly 400, in accordance with one embodiment of the present invention. FIGS. 12A and 12B are different perspective views of an assembled nozzle adjustment assembly 400 while FIG. 12C is an exploded perspective view showing the parts that make up the nozzle adjustment assembly 400. The nozzle adjustment assembly 400 is configured to adjust the position of the spray nozzle assembly relative to the cutting blades. The adjustment is typically performed before a cutting sequence (set-up).

The nozzle adjustment assembly 400 includes a spindle bracket 402. Although not shown, the spindle bracket 402 is typically attached to the spindle assembly as for example the spindle housing associated with a sawing device. The spindle bracket 402 is configured to set the coarse position of the spray nozzle assembly relative to the cutting blades.

The nozzle adjustment assembly 400 also includes a nozzle bracket 404 for supporting a spray nozzle assembly as for example the assembly shown in FIG. 7. The nozzle bracket 404 is configured to pass a fluid (coolant and/or lubricant) between an inlet and an outlet. The inlet generally includes an inlet coupling 406 for receiving a hose from a fluid source and an outlet coupling 408 for receiving the end of the nozzle adjustment assembly. Both the inlet and the outlet couplings 406 and 408 are attached to a bracket body 410. The bracket body 410 includes a fluid passage 412 from the inlet to the outlet. The fluid passage 412 is configured to direct the fluid from the inlet to the outlet. The bracket body 410 also provides a structure for attaching to the spindle bracket 402.

In one embodiment, the nozzle bracket 404 and more particularly the bracket body 410 is movably coupled to the spindle bracket 402 so that the spray nozzle position relative to the cutting blade position can be finely adjusted. In most cases, the nozzle bracket 404 moves linearly relative to the spindle bracket 402. The nozzle bracket 404 can be made to move along a single axis or multiple axis. For example, the nozzle bracket 404 may be configured to only move along the y axis or it may be configured to move along two axis (x and y), all three axis (x, y and z). It may also be configured to rotate about the x, y and z axis.

In the illustrated embodiment, the nozzle bracket 404 and more particularly the bracket body 410 is configured to translate relative to the spindle bracket 402. The direction of translation is parallel to the axis of the spindle and cutting blades (e.g., y axis). By allowing translation in this direction, the spray nozzle assembly can be more precisely placed relative to the cutting edge of the cutting blades. That is, the spray nozzle assembly can be linearly moved so as to properly place the spray nozzles as close as possible to the centerlines of each of the cutting blades.

To elaborate, the nozzle bracket 404 is movably coupled to the spindle bracket 402 via a fine tune translation mechanism 414. The fine tune translation mechanism 414 is configured to convert rotary motion to linear motion. The fine tune translation mechanism 414 includes a travel housing 416, an adjustment housing 418 and a fine tune knob 420. The travel housing 416 is slidably coupled to the spindle bracket 402. This may be accomplished via a travel groove 422 located on the travel housing 416 and a slider 424 located on the spindle bracket 402. The travel groove 422 mates with slider 424 in order to produce the sliding motion. The slider 424 and groove 422 are typically designed in such a way as to keep the travel housing 416 retained to the spindle bracket 402. For example, the slider 424 and travel groove 422 may include tapered or sloped portions to slidably retain the travel housing 416 to the spindle bracket 402.

The travel housing 416 includes an attachment structure 426 to which the nozzle bracket 404 is attached. In most cases, the nozzle bracket 404 is attached to the travel housing 416 with one or more screws or bolts 428. The nozzle bracket 404 may include a slot 430 so that the Z position of the nozzle bracket 404 can be adjusted relative to the travel housing 416 and thus the spindle bracket 402. For example, the screws can be loosened so as to allow the nozzle bracket 404 to slide relative to the travel housing 416 via the slot 430. Once the desired height is found, the screws 428 can be tightened to maintain this height.

The adjustment housing 418 is attached to the spindle bracket 402 via one or more screws or bolts 432. The adjustment housing 418 is configured to rotatably support the fine tube knob 420. That is, the fine tune knob 420 is configured to rotate relative to the adjustment housing 418. The rotation is provided by a fine tune knob 420 that includes a shaft 434 that is inserted in an opening 436 in the adjustment housing 418. The shaft 434 includes a collar 438 that is trapped in a void between a mounting plate 440 and the adjustment housing 418. The collar 438 maintains the knob 420 position relative to the adjustment housing 418 (the mounting plate and adjustment housing serve as y direction abutment stops to the shaft). The shaft 434 also includes a threaded portion 442 at its end that is threadably coupled to a threaded receptacle 444 within the travel housing 416. When the fine tune knob 420 is rotated, the engaged threads pull or push the travel housing 416 along the groove/slider interface. That is, the threaded portion 442 travels into or out of threaded receptacle 44 (depending on the direction of knob rotation) thereby causing linear motion of the travel housing 416. Because the nozzle bracket 404 is attached to the travel housing 416, it to moves linearly along the y axis.

The nozzle bracket 404 may include an angle adjustment elbow 450. The angle adjustment elbow 450 is configured to rotate about the y axis so that the angle of the spray nozzle assembly can be adjusted. This may be needed for deep cuts. The angle adjustment elbow 450 is fluidly and rotatably coupled to the bracket body 410 via an adjustable fitting 452 and typically includes a passage that extends to the outlet coupling 408. The position of the angle adjustment elbow may be set by using a friction coupling or some other fastening means such as a screw or bolt.

Figure 1:
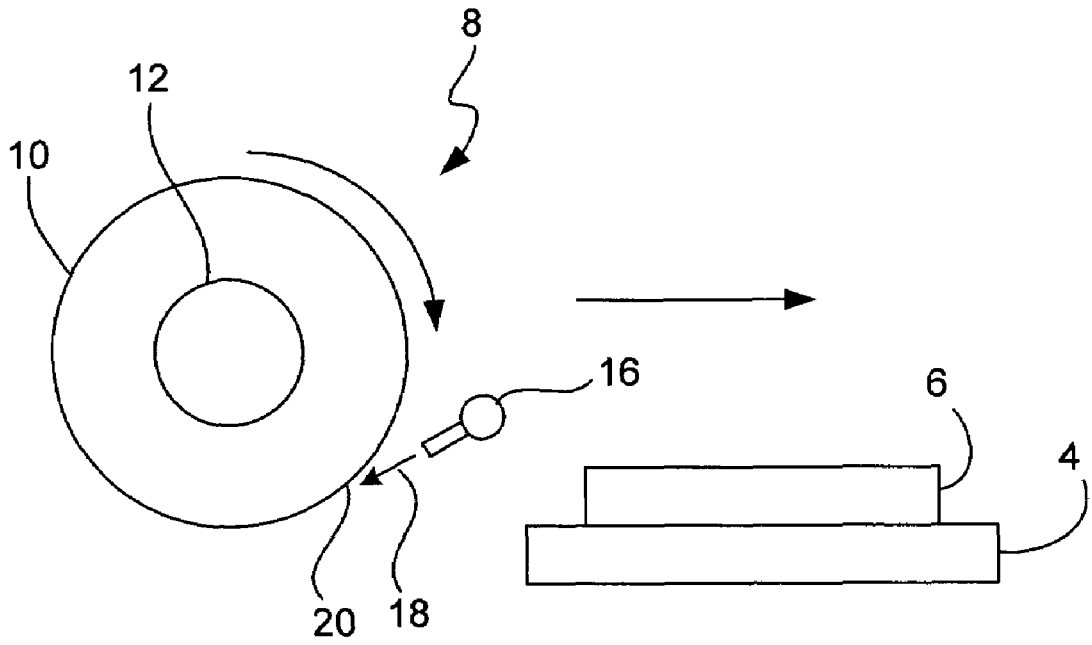
FIG. 1 (PRIOR ART)
FIG. 1 is an exemplary diagram of a conventional dicing apparatus.
Figure 2A:
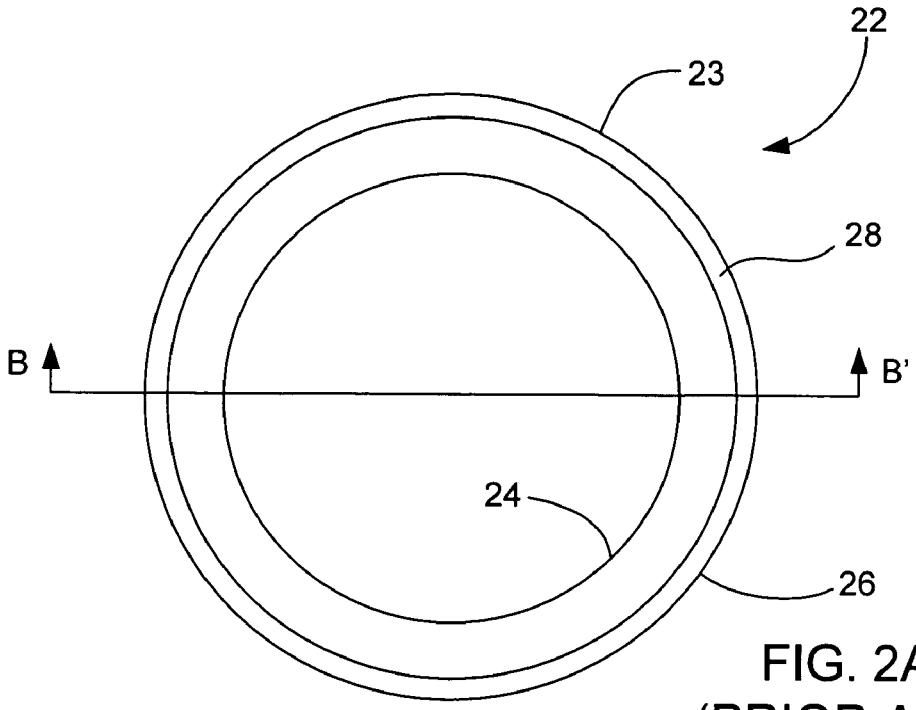
FIG. 2A (PRIOR ART)
FIG. 2A-2C are diagrams of a conventional spacer.
Figure 2B:
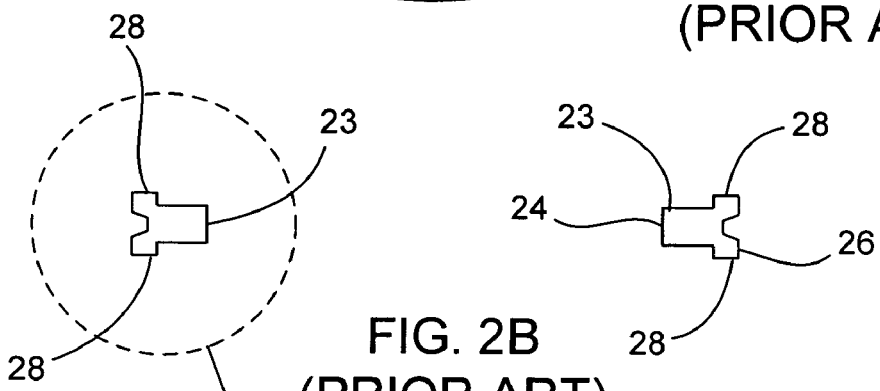
FIG. 2B (PRIOR ART)
Figure 2C:
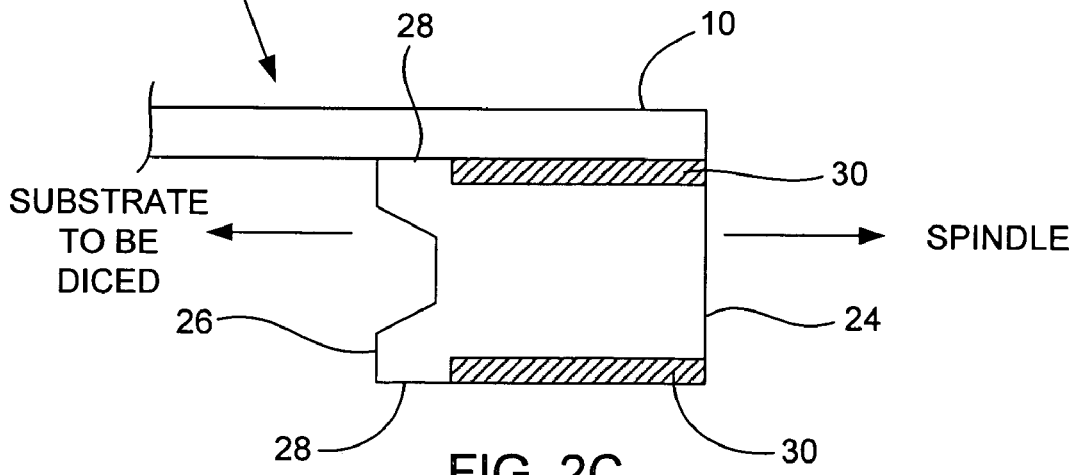
FIG. 2C (PRIOR ART)
Figure 13:
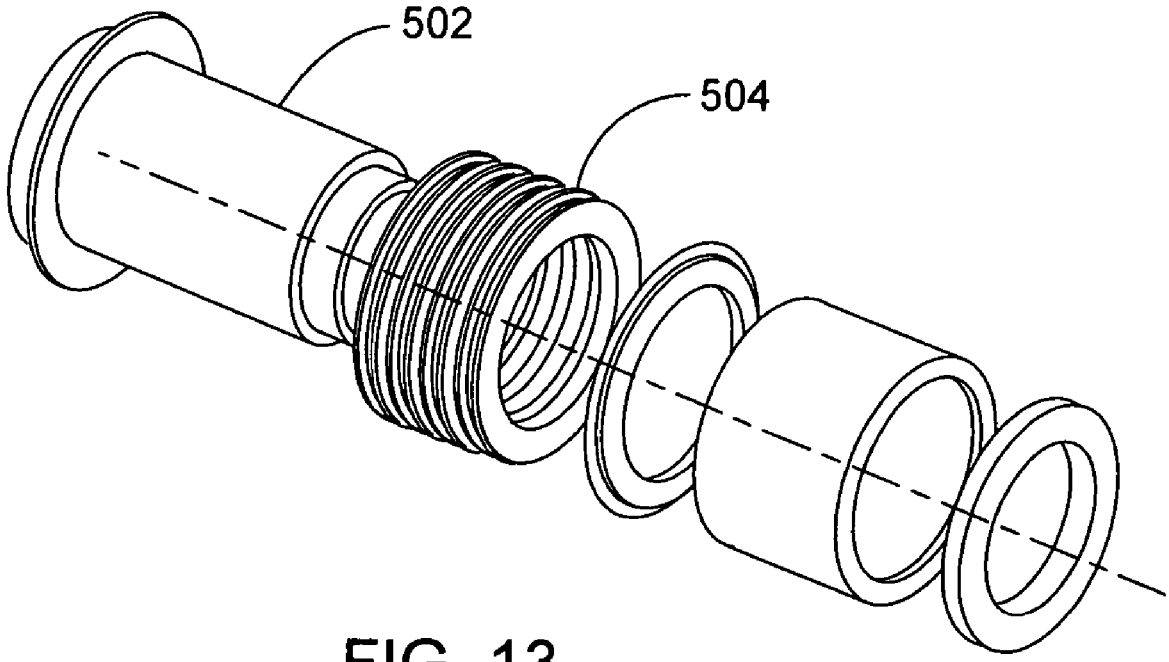
FIG. 13 is a perspective diagram of a spindle assembly, in accordance with one embodiment of the present invention.

A further aspect of the invention relates to the design of spacers that separate cutting blades. As discussed above, substrate are often diced, or singulated into individual packages, by employing rotating cutting blades. Commonly, as shown in FIG. 13 one or more blades having circular cross-sections are placed on a spindle 502, which is then spun to cut a substrate into individual packages. When more than one blade is employed, in a configuration commonly referred to as a gang cutter, each blade is placed on the spindle 502 and separated by a spacer 504, which helps maintain a specified gap between blades (often, the width of each singulated package). Conventional spacers (as shown in FIG. 2) often contain cavities that allow fluids used in the dicing process to collect within the spindle assembly. The weight of this added fluid contributes to spindle imbalance, leading to vibration and inferior cutting and sometimes blade breakage. The spacers of the present invention overcome this problem by eliminating the cavities found in the spacers.

Figure 14A:
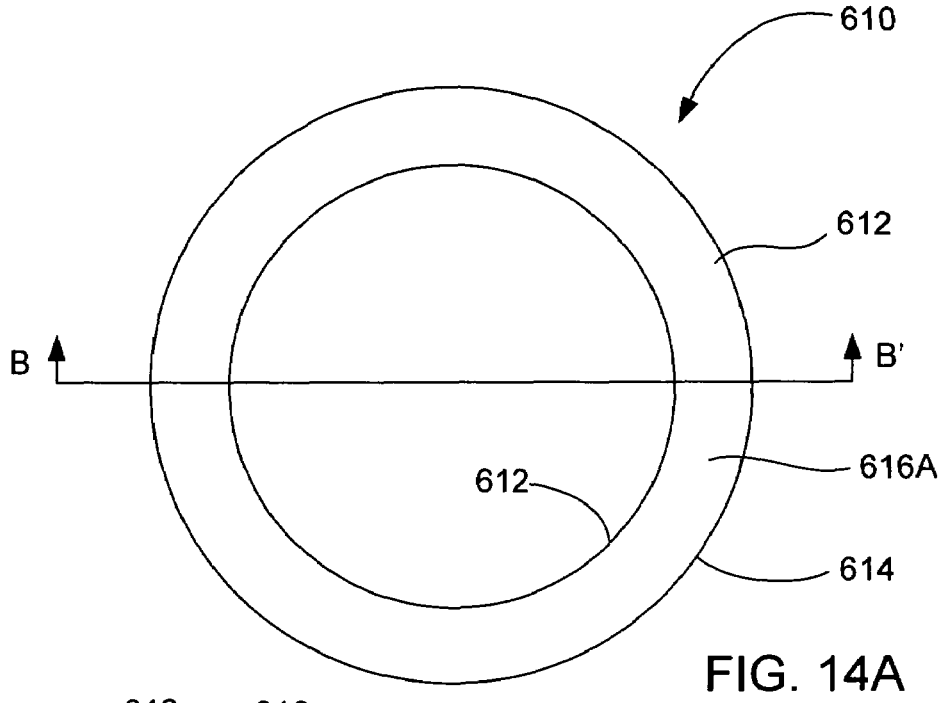
FIGS. 14A-14C are diagrams of a spacer capable of reducing the fluid accumulation problem, in accordance with one embodiment of the present invention.
Figure 14B:
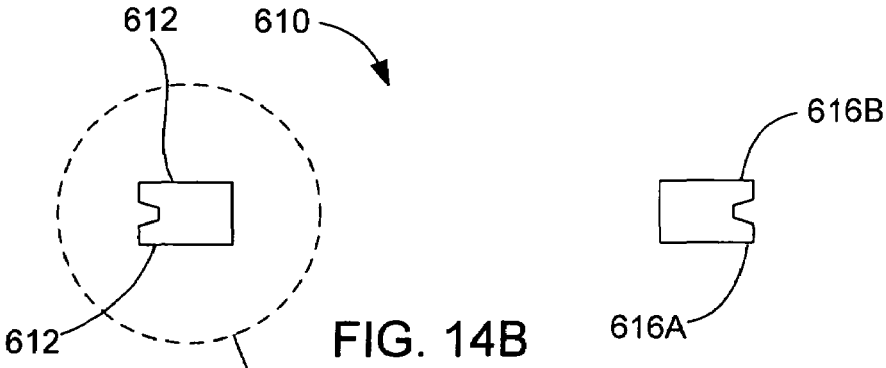
Figure 14C:
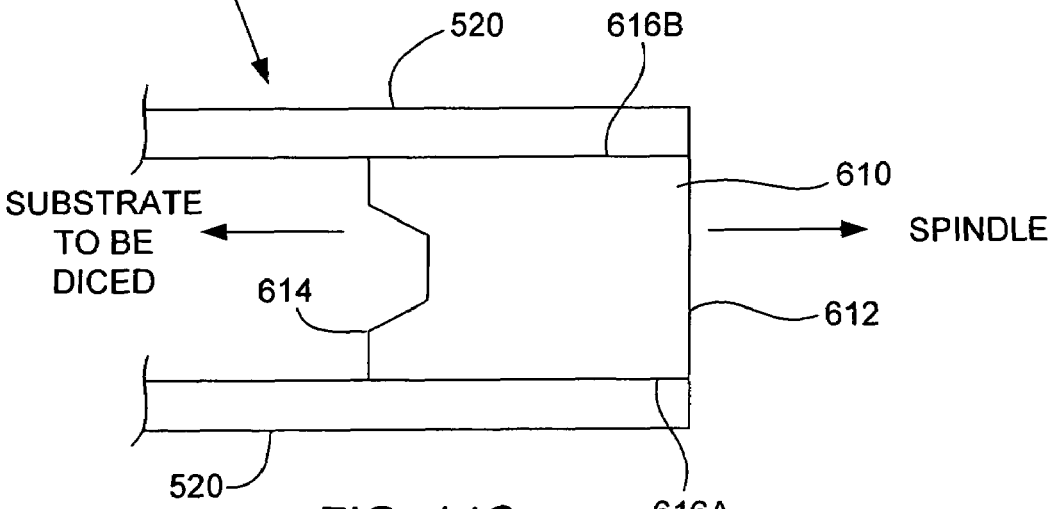

FIGS. 14A-14C are diagrams of a spacer 610 capable of reducing the fluid accumulation problem, in accordance with one embodiment of the present invention. The spacer 610 is annular in shape and includes an inner perimeter 612 and an outer perimeter 614. The inner perimeter 612 is sized and dimensioned for placement around the spindle 502. The spacer 610 also includes two side surfaces 616A and 616B that contact the side surface of blades 520 when the spacers 610 and blades 520 are pressed together as for example, via an axial force applied along the axis of the spindle 502.

Unlike conventional spacers, which have outer raised areas on the side surfaces (see FIG. 2), the spacer 610 shown herein is formed with side surfaces 616A and 616B that are completely flat. Each of the side surfaces 616 lies substantially in one plane between the inner and outer perimeters. As a result, when the spacers 610 are placed against cutting blades 520, the side surfaces 616 lie substantially flush against the side surfaces of the cutting blades 520 with no cavity to collect fluid.

To ensure adequate contact with the blades 520, the surfaces 616 can be fabricated to at least the same degree of flatness and surface finish as the raised surfaces found in conventional spacers. For example, many conventional spacers have raised surfaces that are ground to a flatness of ±2 μm, and a Grade 8 surface finish. Accordingly, spacers 610 can have side surfaces 616 that are ground to at least the same flatness and surface finish, although the invention contemplates surfaces 616 ground to any flatness and surface finish that ensures adequate contact with the cutting blade, and prevents any substantial accumulation of fluid.

While this invention has been described in terms of several preferred embodiments, there are alterations, permutations, and equivalents, which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. A dicing assembly for singulating packaged devices from strips, carriers or substrate of various types, said dicing assembly comprising:

a sawing device including a spindle that rotates relative to a spindle housing and a plurality of cutting blades that are separated by spacers and affixed to the rotating spindle, the rotating cutting blades being configured to cut through strips, carriers or substrates in order to obtain packaged devices therefrom;

a nozzle assembly including, a pipe member in fluid communication with a fluid source;

a nozzle member configured to direct fluid from the pipe member across the cutting blades, the nozzle assembly including a plurality of integral nozzles that are ganged together to form a single unit, the number of nozzles and spacing of the nozzles coinciding with the rotating cutting blades, the nozzles being in fluid communication with the pipe member and extending away from a side of the pipe member, the nozzles each including a through hole and an elongated substantially U-shaped channel having first and second open ends, the through hole starting at the pipe member and opening into the first open end of the elongated substantially U-shaped channel, the elongated substantially U-shaped channel having walls that surround a segment of the rotating cutting blades at the leading edge and at portions of both sides of the rotating cutting blade when the cutting blade is disposed within the channel, the through hole being disposed in front of the leading edge of the cuffing blade when the cutting blade is disposed within the channel, wherein during operation, the cutting blades are rotated, and fluid is directed through the pipe member and into the channels of the nozzles such that the fluid is forced along both the leading edge and a portion of the sides of the rotating cutting blades thereby cooling, cleaning and lubricating the cutting blades.

2. The nozzle assembly as recited in claim 1 wherein the packaged devices are QFN devices.

3. The nozzle assembly as recited in claim 1 wherein the nozzle assembly is attached to the spindle housing.

4. The nozzle assembly as recited in claim 1 wherein the nozzle member includes a reservoir disposed between the pipe member and the through holes, the reservoir helping equalize the flow through each of the through holes.

5. The nozzle assembly as recited in claim 1 wherein the through holes are slots having a height greater than a width.

6. The nozzle assembly as recited in claim 1 wherein each of the nozzles Includes a tapered section to keep the nozzle from interfering with portions of the dicing assembly.

7. The nozzle assembly as recited in claim 1 wherein the nozzles are angled in order to provide a clearance between the nozzle and spacers.

8. A nozzle assembly for directing flow of a fluid across a plurality semiconductor cutting blades that are separated by spacers and affixed to a rotating spindle, comprising:

a longitudinal pipe member having a fluid passage extending therethrough between an open end and a closed second end, the first end being configured to couple to a fluid source, the pipe member having an opening in the side of the longitudinal pipe member between the first and second ends; and a nozzle member attached to the pipe member at the opening in the side of the pipe member, the nozzle member including one or more nozzles, each of the nozzles including a slot in fluid communication with the fluid passage of the pipe member via the opening in the pipe member, and a channel in fluid communication with the slot, the channel being sized and dimensioned to receive an edge of one of the semiconductor cutting blades therein, the slot being disposed at a leading edge of the semiconductor cutting blade when the semiconductor cutting blade is disposed within the channel, the channels including side walls disposed on opposite sides of the semiconductor cutting blade when the semiconductor cutting blade is disposed within the channel and a bottom wall disposed underneath the semiconductor cutting blade when the semiconductor cutting blade is disposed within the channel, the side walls and bottom wall being configured to partially enclose the semiconductor cutting blade in order to direct fluid at the edge of the semiconductor cutting blade, wherein each of the nozzles simultaneously directs the flow of a fluid onto the leading edge of the cutting blade and onto the sides of the cutting blade when the cutting blade is disposed within the channel and when a fluid is forced into the pipe member via the fluid source.

9. The nozzle assembly as recited in claim 8 wherein the nozzle assembly is formed from stainless steel.

10. The nozzle assembly as recited in claim 9 wherein the nozzle member is welded to the pipe member.

* * * * *